US011315780B2

(12) United States Patent
Jarrold et al.

(10) Patent No.: US 11,315,780 B2
(45) Date of Patent: Apr. 26, 2022

(54) CHARGE DETECTION MASS SPECTROMETRY WITH REAL TIME ANALYSIS AND SIGNAL OPTIMIZATION

(71) Applicant: THE TRUSTEES OF INDIANA UNIVERSITY, Bloomington, IN (US)

(72) Inventors: Martin F. Jarrold, Bloomington, IN (US); Benjamin E. Draper, Bloomington, IN (US)

(73) Assignee: The Trustees Of Indiana University, Bloomington, IN (US)

( * ) Notice: Subject to any disclaimer, the term of this patent is extended or adjusted under 35 U.S.C. 154(b) by 0 days.

(21) Appl. No.: 17/058,549

(22) PCT Filed: Jan. 11, 2019

(86) PCT No.: PCT/US2019/013277

§ 371 (c)(1),
(2) Date: Nov. 24, 2020

(87) PCT Pub. No.: WO2019/236140

PCT Pub. Date: Dec. 12, 2019

(65) Prior Publication Data

US 2021/0210332 A1 Jul. 8, 2021

Related U.S. Application Data

(60) Provisional application No. 62/680,245, filed on Jun. 4, 2018.

(51) Int. Cl.

| | |
|---|---|
| ***H01J 49/00*** | (2006.01) |
| ***H01J 49/42*** | (2006.01) |
| ***H01J 49/02*** | (2006.01) |

(52) U.S. Cl.

CPC ..... *H01J 49/425* (2013.01); *H01J 49/0031* (2013.01); *H01J 49/0036* (2013.01); *H01J 49/025* (2013.01)

(58) Field of Classification Search

CPC .. H01J 49/425; H01J 49/0031; H01J 49/0036; H01J 49/025; H01J 49/4245; H01J 49/027

(Continued)

(56) References Cited

U.S. PATENT DOCUMENTS

| | | | |
|---|---|---|---|
| 3,019,168 | A | 1/1962 | Taylor |
| 5,285,063 | A | 2/1994 | Schwartz et al. |

(Continued)

FOREIGN PATENT DOCUMENTS

| | | | |
|---|---|---|---|
| WO | 1998011244 | A1 | 3/1998 |
| WO | 1999061601 | A1 | 12/1999 |

(Continued)

OTHER PUBLICATIONS

Doussineau, et al ("Infrared multiphoton dissociation tandem charge detection-mass spectrometry of single megadalton electrosprayed ions," Rev. Sci. Instrum. vol. 82, No. 8, Aug. 1, 2011, p. 084104, 8 pages (Year: 2011).*

(Continued)

*Primary Examiner* — Michael Maskell
(74) *Attorney, Agent, or Firm* — Barnes & Thornburg LLP

(57) ABSTRACT

A charge detection mass spectrometer may include an electrostatic linear ion trap (ELIT) or an orbitrap, an ion source to supply ions thereto, at least one amplifier operatively coupled to the ELIT or orbitrap, a processor coupled to ELIT or orbitrap and to the amplifier(s), and processor programmed to control the ELIT or orbitrap as part of a trapping event to attempt to trap therein a single ion supplied by the ion source, to record ion measurement information based on output signals produced by the amplifier(s) over a duration of the trapping event, to determine, based on the measurement information, whether the control of the ELIT or (Continued)

orbitrap resulted in trapping of a single ion, no ion or multiple ions, and to compute an ion mass or mass-to-charge ratio from the measurement information only if a single ion was trapped during the trapping event.

18 Claims, 11 Drawing Sheets

(58) Field of Classification Search
USPC ..... 250/281, 282
See application file for complete search history.

(56) References Cited

U.S. PATENT DOCUMENTS

| | | | |
|---|---|---|---|
| 5,478,745 | A | 12/1995 | Samulski |
| 5,572,025 | A | 11/1996 | Cotter |
| 5,770,857 | A | 6/1998 | Fuerstenau et al. |
| 5,863,541 | A | 1/1999 | Samulski et al. |
| 5,869,248 | A | 2/1999 | Yuan et al. |
| 5,877,022 | A | 3/1999 | Stinchcomb et al. |
| 5,880,466 | A | 3/1999 | Benner |
| 5,882,652 | A | 3/1999 | Vaides et al. |
| 5,886,346 | A | 3/1999 | Makarov |
| 5,905,040 | A | 5/1999 | Mazzara et al. |
| 5,916,563 | A | 6/1999 | Young et al. |
| 6,013,487 | A | 1/2000 | Mitchell |
| 6,083,702 | A | 7/2000 | Mitchell et al. |
| 6,156,303 | A | 12/2000 | Russell et al. |
| 6,183,950 | B1 | 2/2001 | Madonna |
| 6,583,408 | B2 | 6/2003 | Smith et al. |
| 6,744,042 | B2 | 6/2004 | Zajfman et al. |
| 6,753,523 | B1 | 6/2004 | Whitehouse |
| 6,888,130 | B1 | 5/2005 | Gonin |
| 7,314,912 | B1 | 1/2008 | Hallek et al. |
| 7,829,842 | B2 | 11/2010 | Makarov |
| 8,294,085 | B2 | 10/2012 | Ding |
| 8,395,112 | B1 | 3/2013 | Bier |
| 8,409,870 | B2 | 4/2013 | Van Wuijckhuijse |
| 9,095,793 | B2 | 8/2015 | Flagan |
| 10,056,244 | B1 | 8/2018 | Quarmby et al. |
| 2003/0155502 | A1 | 8/2003 | Grosshans et al. |
| 2004/0169137 | A1 | 9/2004 | Westphall et al. |
| 2005/0236375 | A1 | 10/2005 | Gefter et al. |
| 2007/0254352 | A1 | 11/2007 | Schaffer et al. |
| 2009/0020694 | A1 | 1/2009 | Flory |
| 2009/0078866 | A1 | 3/2009 | Li et al. |
| 2010/0084549 | A1 | 4/2010 | Ermakov et al. |
| 2010/0084552 | A1 | 4/2010 | Kawana |
| 2010/0090102 | A1 | 4/2010 | Rather et al. |
| 2010/0227310 | A1 | 9/2010 | Manalis et al. |
| 2010/0234837 | A1 | 9/2010 | Alfano |
| 2010/0314538 | A1 | 12/2010 | Makarov et al. |
| 2010/0320377 | A1 | 12/2010 | Cotter |
| 2011/0095175 | A1 | 4/2011 | Bateman |
| 2011/0240845 | A1 | 10/2011 | Ding |
| 2012/0112056 | A1 | 5/2012 | Brucker et al. |
| 2012/0282641 | A1 | 11/2012 | Reilly et al. |
| 2013/0175440 | A1 | 7/2013 | Perelman et al. |
| 2013/0124099 | A1 | 8/2013 | Ecker |
| 2013/0200261 | A1 | 8/2013 | Mizutani et al. |
| 2013/0234017 | A1 | 9/2013 | Kaltashov et al. |
| 2013/0327934 | A1 | 12/2013 | Makarov et al. |
| 2014/0197333 | A1 | 7/2014 | Jolliffe et al. |
| 2014/0346344 | A1 | 11/2014 | Chen |
| 2015/0008316 | A1 | 1/2015 | Guna |
| 2015/0021472 | A1 | 1/2015 | Makarov |
| 2015/0325425 | A1 | 11/2015 | Makarov |
| 2015/0331000 | A1 | 11/2015 | Collier et al. |
| 2016/0005580 | A1 | 1/2016 | Grinfeld |
| 2016/0035556 | A1 | 2/2016 | Berkout et al. |
| 2016/0181084 | A1 | 6/2016 | Smith |
| 2016/0336165 | A1 | 11/2016 | Guna |
| 2017/0040152 | A1 | 2/2017 | Makarov |
| 2017/0307565 | A1 | 10/2017 | Clemmer et al. |
| 2017/0372883 | A1 | 12/2017 | Verenchikov |
| 2020/0243317 | A1 | 7/2020 | Lopez-Hilfiker et al. |
| 2020/0357626 | A1 | 11/2020 | Jarrold et al. |

FOREIGN PATENT DOCUMENTS

| | | | |
|---|---|---|---|
| WO | 2000028004 | A1 | 5/2000 |
| WO | 2000028061 | A1 | 5/2000 |
| WO | 2001092551 | A2 | 5/2001 |
| WO | 003042704 | A1 | 5/2003 |
| WO | 2006130474 | A2 | 12/2006 |
| WO | 2010135830 | A1 | 12/2010 |
| WO | 20120083031 | A1 | 6/2012 |
| WO | 012145037 | A1 | 10/2012 |
| WO | 016073850 | A1 | 5/2016 |
| WO | 017162779 | A1 | 9/2017 |
| WO | 20170190031 | A1 | 11/2017 |
| WO | 20190140233 | A1 | 7/2019 |
| WO | 2019231854 | A1 | 12/2019 |

OTHER PUBLICATIONS

Keifer, et al ("Charge detection mass spectrometry: weighing heavier things," The Analyst, UK vol. 142, No. 10, Jan. 1, 2017, pp. 1654-1671 (Year: 2017).*

Draper, Benjamin E., "The FUNPET—a New Hybrid Ion Funnel-Ion Carpet Atmospheric Pressure Interface for the Simultaneous Transmission of a Broad Mass Range", Journal of the American Society of Mass Spectrometry 29, 2160-2172, Aug. 15, 2018.

El-Baba, Tarick J., et al., "Melting Proteins Confined in Nanodroplets With 10.6 um Light Provided Clues About Early Steps of Denaturation", Chemical Communications, vol. 54, No. 26, 3270-3273, 2018.

Heller, Manfred, et al. "Mass Spectrometry-Based Analytical Tools for the Molecular Protein Characterization of Human Plasma Lipoproteins", Proteomics 2005, 5, 2619-2630.

Hutchins, Patrick M., et al. "Quantification of HDL Particle Concentration by Calibrated Ion Mobility Analysis", Clinical Chemistry 60:11, 1393-1401, 2014.

Kukreja, Alexander A., et al. "Structurally Similar Woodchuck and Human Hepadnavirus Core Proteins Having Distinctly Different Temperature Dependencies of Assembly" Journal of Virology, vol. 68, No. 24, 14105-14115, Sep. 24, 2014.

PCT International Search Report and Written Opinion completed by the ISA/EP dated Sep. 9, 2019 and issued in connection with PCT/US2020/035379.

PCT International Search Report and Written Opinion completed by the ISA/EP dated Aug. 27, 2019 and issued in connection with PCT/US2019/035381.

PCT International Search Report and Written Opinion completed by the ISA/EP dated Mar. 8, 2021 and issued in connection with PCT/US2020/065300.

PCT International Search Report and Written Opinion completed by the ISA/EP dated Mar. 8, 2021 and issued in connection with PCT/US2020/065301.

PCT International Search Report and Written Opinion completed by the ISA/US dated Apr. 5, 2021 and issued in connection with PCT/US2021/016435.

PCT International Search Report and Written Opinion completed by the ISA/US dated Mar. 18, 2021 and issued in connection with PCT/US2021/016325.

Koizumi et al., A novel phase-coherent programmable clock for high-precision arbitrary waveform generation applied to digital ion trap mass spectrometry_ Int. J_ Mass Spectrom_ 292, 23-31 (2010).

Konenkov et al., Matrix methods for the calculation of stability diagrams in quadrupole mass spectrometry. J. Amer. Soc. Mass Spec. 13, 597-613 {2002).

Landais et al., Varying the radio frequency: A new scanning mode for quadrupole analyzers. Rapid Commun. Mass Spectrom. 12, 302-306 (1998).

Makarov, Alexander, "Electrostatic Axially Harmonic Orbital Trapping: A High-Performance Technique of Mass Analysis", Analytical Chemistry, vol. 72, No. 6, Mar. 1, 2000 (Mar. 1, 2000), p. 1156-1162.

(56) References Cited

OTHER PUBLICATIONS

Marmet et al., A frequency-swept quadrupole mass filler. Int. J_ Mass Spectrom. Ion Proc. 42, 3-10 (1982).
Martin, Stability of doubly charged alkali halide clusters. J_ Chem. Phys. 76, 5467-5469 (1982).
Miyamura, K., et al. "Parvovirus Particles as Platforms for Protein Presentation", National Academy of Sciences, vol. 1,No. 18,pp. 8507-8511 (Aug. 30, 1994).
Mori, Seiichiro, Mori, et al. "Two novel adeno-associated viruses from cynomolgus monkey: pseudotyping characterization of capsid protein", Virology 330, pp. 375-383 (2004).
Muzyczka, N., "Use of Adeno-Associated Virus as a General Transduction Vector for Mammalian Cells", Current Topics n Microbiology and Immunology, vol. 158, pp. 97-129 (1992).
Muramatsu, S., et al. "Nucleotide Sequencing and Generation of an Infectious Clone of Adeno-Associated Virus 3", Virology vol. 221; Article No. 0367; pp. 208-217 (1996).
Padron, Eric, et al. "Structure of Adeno-Associated Virus Type 4", Journal of Virology, vol. 79, No. 8, pp. 5047-5058 Apr. 2005).
Puttaraju, M., et al. "Spliceosome-mediated RNA trans-splicing as a tool for gene therapy", Nature Biotechnology, vol. 17, pp. 246-252 (Mar. 1999).
Nie et al., Frequency scan of a quadrupole mass analyzer in the third stability region for protein analysis. J. Chin. Chem_ Soc , 53, 47-52 (2006).
Paul, et al., Das elektrische massenfiller, Z. Phys. 140, 262-273 (1955).
Pierson, Elizabeth E., et al., "Detection of 1-15 Late Intermediates in Virus Capsid Assembly by Charge Detection Mass Spectrometry", Journal of the American Chemical Society, vol. 136, No. 9, Feb. 19, 2014, 3536-3541.
Pierson, Elizabeth E., et al., Charge Detection Mass Spectrometry for Single Ions with an Uncertainty in the Charge Measurement of 0.65 e; Elizabeth E_ Pierson et al.; Journal American Society for Mass Spectrometry, vol. 26, pp. 1213-1220 (2015).
Pierson, Elizabeth E., et al. "Charge Detection Mass Spectrometry Identifies Preferred Non-icosahedral Polymorphs in the Self-Assembly of Woodchuck Hepatitis Virus Capsids", Jour. of Molecular Biology, vol. 428, Issue 2, pp. 292-300. Jan. 29, 2016.
Schlunegger et al., Frequency scan for the analysis of high mass ions generated by matrix-assisted laser esorption/ionization in a Paul trap_ Rapid Commun. Mass Spectrom. 13, 1792-1796 (1999).
Richards et al., A new operating mode for the quadrupole mass filler. Int. J. Mass Spectrom. Ion Phys. 12, 317-339 1973).
Richards et al., Waveform parameter tolerances for the quadrupole mass filler with rectangular excitation. Int. J. Mass Spectrom. Ion Phys_ 15, 417-428 (1974).
Sonalikar, Hrishikesh S., et al. "Numerical analysis of segmented-electrode Orbitraps", International Journal of Mass Spectrometry, Elsevier Science Publishers, Amsterdam, NL,vol. 395, Dec. 17, 2015 (Dec. 17, 2015), p. 36-48.
Shinholt, Review of Scientific Instruments. 85, 113109 (2014); doi: 10.1063/1.4900627.
Sobott et al., A tandem mass spectrometer for improved transmission and analysis of large macromolecular Assemblies. Anal. Chem. 74, 1402-1407 (2002).
Syed, et al., Quadrupole mass filler: Design and performance for operation in stability zone 3. J. Am. Soc. Mass Spectrom. 24, 1493-1500 (2013).
Shade, Rosemary, et al. "Nucleotide Sequence and Genome Organization of Human Parvovirus B19 Isolated from the Serum of a Child during plastic Crisis", Journal of Virology, vol. 58, No. 3, pp. 921-936 {Jun. 1986).
Sharp, Phillip A., et al. "RNA Interference", American Association for the Advancement of Science; Science, New Series, vol. 287, No. 5462, pp. 2431-2433 {Mar. 31, 2000).
Shi, Z., et al. "Insertional Mutagenesis at Positions 520 and 584 of Adena-Associated Virus Type 2 (MV2) Capsid Gene and Generation of MV2 Vectors with Eliminated Heparin-Binding Ability and Introduced Novel Tropism", Human Gene Therapy, vol. 17, pp. 353-361 (Mar. 2006).
Srivastava, Arun, et al., "Nucleotide Sequence and Organization of the Adena-Associated Virus 2 Genome", Journal of Virology, vol. 45, No. 2, pp. 555-564 {Feb. 1983).
Tsao, Jun, et al., "The Three-Dimensional Structure of Canine Parvovirus and Its Functional Implications", American Association for the Advancement of Science, Science, New Series, vol. 251, No. 5000, pp. 1456-1464 {Mar. 22, 991).
Walters, Robert W., "Structure of Adeno-Associated Virus Serotype 5", Journal of Virology, vol. 78, No. 7, pp. B361-3371 {Apr. 2004).
Wang, Lei, et al., "Expanding the Genetic Code", Annual Review of Biophysics and Biomolecular Structure, vol. 35, pp. 25-249 {2006).
Xie, Qing, et al., "Canine Parvovirus Capsid Structure, Analyzed at 2.9 A Resolution", Journal of Molecular Biology, vol. 64, pp. 497-520 (1996).
Xie, Qing, et al., "The atomic structure of adeno-associated virus (MV-2), a vector for human gene therapy", PNAS, vol. 99, No. 16, pp. 10405-10410 (Aug. 6, 2002).
Xiao, Weidong, et al., "Gene Therapy Vectors Based on Adena-Associated Virus Type 1", Journal of Virology, vol. 73, No. 5, pp. 3994-4003 (May 1999).
Uetrecht et al., "Stability and Shape of Hepatitis B Virus Capsids In Vacuo", Angew. Chem. Int. Ed. 2008 ,47, 6247-6251.
Uetrecht et al., "High-resolution mass spectrometry of viral assemblies: Molecular composition and stability of dimorphic hepatitis B virus capsids", PNAS 2008, vol. 105, 9216-9920.
Winger, et al., Observation and implications of high mass-lo-charge ratio ions from electrospray ionization mass spectrometry, J_ Am_ Soc_ Mass Spectrom. 4, 536-545 (1993).
Xiong, et al., The development of charge detection-quadrupole ion trap mass spectrometry driven by rectangular and triangularwaves, Analyst 137, 1199-1204 (2012).
Yang, et al., Development of a palm portable mass spectrometer. J. Amer. Soc. Mass Spec. 19, 1442-1448 (2008).
Yost, et al., Selected ion fragmentation with a tandem quadrupole mass spectrometer. J. Am. Chem. Soc. 100, 274-2275 (1978).
Bioconjugate Techniques; Hermanson; .Academic Press, 1st Edition (1996),. (book reference, to be made available upon request).
PCT International Search Report and Written Opinion completed by the ISA/EP dated Apr. 18, 2019 and issued in connection with PCT/US2019/013251.
PCT International Search Report and Written Opinion completed by the ISA/EP dated Apr. 16, 2019 and issued in connection with PCT/US2019/013274.
PCT International Search Report and Written Opinion completed by the ISA/EP dated Mar. 27, 2019 and issued in connection with PCT/US2019/013277.
PCT International Search Report and Written Opinion completed by the ISA/EP dated Jul. 24, 2019 and issued in connection with PCT/US2019/013278.
PCT International Search Report and Written Opinion completed by the ISA/EP dated Sep. 9, 2019 and issued in connection with PCT/US2019/013279.
PCT International Search Report and Written Opinion completed by the ISA/EP dated Mar. 28, 2019 and issued in connection with PCT/US2019/013280.
PCT International Search Report and Written Opinion completed by the ISA/EP dated Aug. 27, 2019 and issued in connection with PCT/US2019/013281.
PCT International Search Report and Written Opinion completed by the ISA/EP dated Mar. 27, 2019 and issued in connection with PCT/US2019/013283.
PCT International Search Report and Written Opinion completed by the ISA/EP dated Mar. 29, 2019 and issued in connection with PCT/US2019/013284.
PCT International Search Report and Written Opinion completed by the ISA/EP dated Jul. 26, 2019 and issued in connection with PCT/US2019/013285.
PCT International Search Report and Written Opinion completed by the ISA/US dated Jan. 12, 2016 and issued in connection with PCT/US2015/059463.

(56) References Cited

OTHER PUBLICATIONS

PCT International Search Report and Written Opinion completed by the ISA/US dated Jun. 19, 2017 and issued in connection with PCT/US2017/030163.
PCT International Search Report and Written Opinion completed by the ISA/EP dated Feb. 14, 2019 and issued in connection with PCT/US2018/051944.
Supplemental European Search Report for European Patent Application No. 17790559.3 dated Nov. 12, 2019 (11 pages).
Anthony, Staci N. "MS /MS instrumentation for megadalton-sized ions", 2016, XP055619426, ISBN: 978-1-369-02558-3 Retrieved from the Internet: URL:https://search.proquest.com/docview/1830450391?accountid=29404.
Anthony, et al., A simple electrospray interface based on a DC ion carpet, Int. J. Mass Spectrom. 371, 1-7 (2014).
Bantel-Schall, U., et al., "Human Adena-Associated Virus Type 5 Is Only Distantly Related to Other Known Primate Helper-Dependent Parvoviruses", Journal of Virology, vol. 73, pp. 939-947 {Feb. 1999).
Beuhler, et al., Threshold studies of secondary electron emission induced by macro ion impact on solid surfaces. Nucl. Instrum. Methods 170, 309-315 (1980).
Beuhler, et al., A study of the formation of high molecular weight water cluster ions {m/e < 59000) in expansion of ionized gas mixtures, J. Chem. Phys. 77, 2549-2557 (1982).
Brancia, et al., Digital asymmetric waveform isolation {DAWI) in a digital linear ion trap. J_ Am. Soc_ Mass Spectrom. 1. 1530-1533 (2010).
Brown, C., et al. "Chimeric Parvovirus B19 Capsids for the Presentation of Foreign Epitope",; Virology 198, pp. J77-488 (1994).
Burnham, et al. "Analytical Ultracentrifugation as an Approach to Characterize Recombinant Adena-Associated Viral Vectors", Human Gene Therapy Methods, vol. 26, No. 6; pp. 228-242, Oct. 15, 2015.
Chao, Hengjun, et al. "Several Log Increase in Therapeutic Transgene Delivery by Distinct Adena-Associated Viral Serotype Vectors" Molecular Therapy vol. 2, No. 6, pp. 619-623 {Dec. 2000).
Chiorini, John A., et al. "Cloning of Adeno-Associated Virus Type 4 (MV4) and Generation of Recombinant MV4 Particles",Journal of Virology, vol. 71, pp. 6823-6833 {Sep. 1997).
Chiorini, John A., "Cloning and Characterization of Adeno-Associated Virus Type 5", Journal of Virology, vol. 73, DP-1309-1319 {Feb. 1999).
Chernushevich, et al., Collisional cooling of large ions in electrospray mass spectrometry. Anal. Chem 76. H54-1760 (2004).
Cleves, Ann E., "Protein transport: The nonclassical ins and outs", Current Biology, vol. 7, No. 5, pp. 318-320 (1997).
Contino, Nathan Colby, "Ion trap charge detection mass spectrometry: Lowering limits of detection and improving signal to noise", ISBN: 9781303535048, Jul. 30, 2013 (Jul. 30, 2013).
Ding, et al., A simulation study of the digital ion trap mass spectrometer. Int. J. Mass Spectrom. 221, 117-138 {2002).
Ding, et al, A digital ion trap mass spectrometer coupled with atmospheric pressure ion sources. J_ Mass Spectrom. 69, 471-484 (2004).
Douglas J_ Linear quadrupoles in mass spectrometry. Mass Spectrom. Rev. 28, 937-960 (2009).
Doussineau, Tristan, et al. "Infrared multiphoton dissociation tandem charge detection-mass spectrometry of single megadalton electrosprayed ions", Review of Scientific Instruments, AIP, Melville, NY, US, vol. 82, No. 8, Aug. 1, 2011, pp. 84104-84104.
Elliott, Andrew G., et al. "Simultaneous Measurements of Mass and Collisional Cross-Section of Single Ions with charge Detection Mass Spectrometry", Analytical Chemistry, vol. 89, No. 14, Jun. 16, 2017, pp. 7701-7708.
Elliott, Andrew G., et al. "Effects of Individual Ion Energies on Charge Measurements in Fourier Transform Charge Detection Mass Spectrometry (FT-CDMS)", Journal of the American Society for Mass Spectrometry., Nov. 14, 2018 (Nov. 14, 2018).
Elliott, Andrew G., et al. "Single Particle Analyzer of Mass: A Charge Detection Mass Spectrometer with a Multi-Detector Electrostatic Ion Trap", International Journal of Mass Spectrometry, Elsevier Science Publishers, Amsterdam, NL, vol. 414, Jan. 15, 2017, pp. 45-55.
Emerson, S., et al. "Hepatitis E Virus", Virology, vol. 2, Chapter 70; (4th ed., Lippincott-Raven Publishers).
Fields, Bernard, et al. "Darvoviridae: The Viruses and Their Replication" Virology, vol. 2, Chapter 69, pp. 2327-2359; 4th ed., Lippincott-Raven Publishers).
Fuerstenau, et al., "Mass Spectrometry of an Intact Virus", Agnew. Chem. 2001, 559-562.
Gao, Guangping, et al. "Clades of Adeno-Associated Viruses Are Widely Disseminated in Human Tissues", vol. 78, pp. 6381-6388 (Jun. 2004).
Gao, Guangping, et al. "Novel Adeno-Associated Viruses from Rhesus Monkeys as Vectors for Human GeneTherap",.; National Academy of Sciences, vol. 99, No. 18, pp. 11854-11859 {Sep. 3, 2002).
Gorman, Linda, et al. "Stable Alteration of Pre-mRNA Splicing Patterns by Modified U7 Small Nuclear RNAs", National Academy of Sciences, vol. 95, No. 9, pp. 4929-4934 (Apr. 28, 1998).
Grifman, M., et al. "Incorporation of Tumor-Targeting Peptides into Recombinant Adeno-associated Virus Capsids",.; Molecular Therapy, vol. 3, No. 6, pp. 964-975 (Jun. 2001).
Grinfeld, Dmitry, et al. "Space-Charge Effects in an Electrostatic Multireflection Ion Trap", European Journal of Mass Spectrometry,vol. 20, No. 2, Apr. 1, 2014 (Apr. 1, 2014), p. 131-142.
Hauck, B., et al. "Characterization of Tissue Tropism Determinants of Adeno-Associated Virus Type 1", Journal of Virology, vol. 77, No. 4, pp. 2768-2774 (Feb. 2003).
Hogan, Joanna, et al. "Optimized Electrostatic Linear Ion Trap for Charge Detection Mass Spectrometry", Jul. 9, 2018 (Jul. 9, 2018), vol. 29, No. 10, p. 2086-2095.
Keifer, David Z., "Single-Molecule Mass Spectrometry", Mass Spectrometry Reviews, vol. 36 pp. 715-733 (2017).
Keifer, David Z., et al. "Charge detection mass spectrometry: weighing heavier things" The Analyst, vol. 142, No. 10, Jan. 1, 2017, pp. 1654-1671.
Keifer, David Z., et al. "Charge Detection Mass Spectrometry with Almost Perfect Charge Accuracy", Analytical Chemistry, vol. 87, No. 20, Oct. 20, 2015, pp. 10330-10337.
Kelly, Ryan T., et al. "The ion funnel: Theory, implementations, and applications", Mass Spectrometry Reviews., vol. 29, Apr. 23, 2009, pp. 294-312.
Kim et al., A multicapillary inlet jet disruption electrodynamic ion funnel interface for improved sensitivity using tmospheric pressure ion sources. Anal. Chem. 73, 4162-4170 {2001).
Botamanenko, Daniel, et al., "Ion-Ion Interactions in Charge Detection Mass Spectrometry", J Am Soc Mass Spectrom. Dec. 2019; 30(12): 2741-2749. doi:10.1007/s13361-019-02343-y.
Draper, Benjamin E., et al., "Real-Time Analysis and Signal Optimization for Charge Detection Mass Spectrometry", J. Am. Soc. Mass Spectrom. (2019) 30:898Y904.
Todd, Aaron R., et al. "Implementation of a Charge-Sensitive Amplifier without a Feedback Resistor for Charge Detection Mass Spectrometry Reduces Noise and Enables Detection of Individual Ions Carrying a Single Charge", J. Am. Soc. Mass Spectrom. 2020, 31,146-154.
PCT International Search Report and Written Opinion completed by the ISA/EP dated Jul. 14, 2020 and issued in connection with PCT/US2020/029287.
PCT International Search Report and Written Opinion completed by the ISA/US dated Nov. 23, 2020 and issued in connection with PCT/US2020/052009.
PCT International Search Report and Written Opinion completed by the ISA/US dated Jan. 24, 2021 and issued in connection with PCT/US2020/054975.
Paul et al., Das elektrische massenfilter als massenspektromeler und isotopenlrenner. Z. Phys. 152, 143-182 (1958).

* cited by examiner

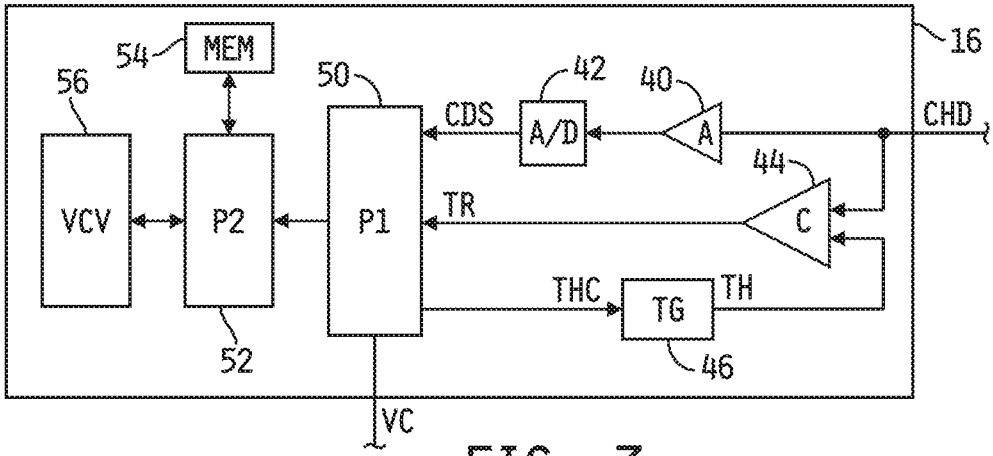
FIG. 3
FIG. 4A
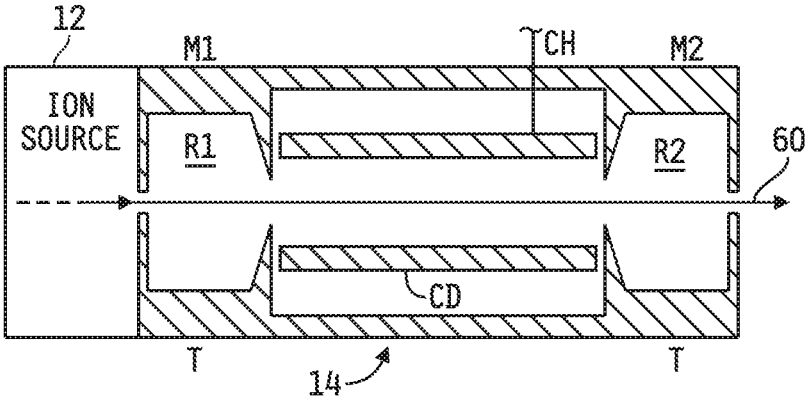
FIG. 4B
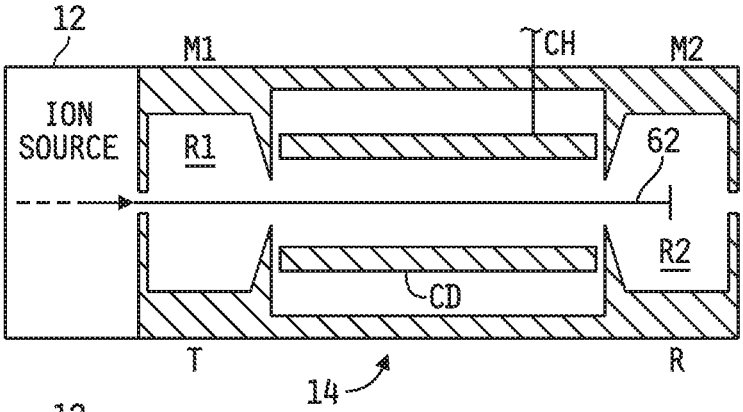
FIG. 4C
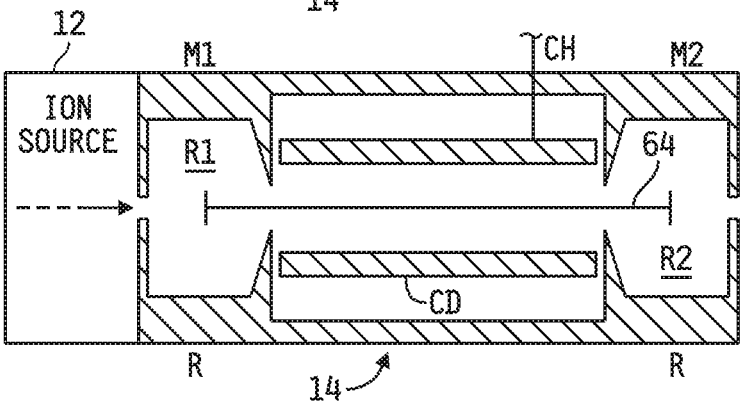

134 140 142 144 146

```
chA103111.dat  m/z:  26075.02  z:  163.30  m:     4258048.50  time:  0.096886
 chA103131.dat: 0
chA103115.dat  m/z:  26736.24  z:  157.14  m:     4201308.50  time:  0.096845
 chA103134.dat: 0
 chA103138.dat: 0
chA103144.dat  m/z:  26757.96  z:  145.69  m:     3898496.25  time:  0.042965
 chA103136.dat: 0
 chA103139.dat: 0
 chA103133.dat: 0
 chA103142.dat: 0
chA103114.dat  m/z:  25830.60  z:  239.41  m:     6184379.00  time:  0.096856
 chA103140.dat: 0
 chA103141.dat: 0
chA103120.dat  m/z:  25507.47  z:  158.26  m:     4036758.75  time:  0.096848
 chA103146.dat: 0
 chA103151.dat: 0
 chA103164.dat:                                          MULTIPLE ION EVENT
chA103127.dat  m/z:  26442.56  z:  154.51  m:     4085461.25  time:  0.096834
chA103102.dat  m/z:  13912.89  z:   51.15  m:      711529.19  time:  0.096863
 chA103168.dat:                                          MULTIPLE ION EVENT
 chA103169.dat:                                          MULTIPLE ION EVENT
 chA103149.dat: 0
chA103137.dat  m/z:  26669.67  z:  194.18  m:     5180696.50  time:  0.083232
chA103132.dat  m/z:  24112.21  z:  127.51  m:     3074748.50  time:  0.096860
chA103121.dat  m/z:  13821.91  z:   61.33  m:      847682.00  time:  0.096852
 chA103159.dat: 0
 chA103175.dat:                                          MULTIPLE ION EVENT
 chA103176.dat:                                          MULTIPLE ION EVENT
 chA103157.dat: 0
 chA103163.dat: 0
 chA103153.dat: 0
 chA103156.dat: 0
 chA103161.dat: 0
 chA103162.dat: 0
 chA103182.dat:                                          MULTIPLE ION EVENT
```

136

138

FIG. 6B

CHARGE DETECTION MASS SPECTROMETRY WITH REAL TIME ANALYSIS AND SIGNAL OPTIMIZATION

CROSS-REFERENCE TO RELATED APPLICATIONS

This application is a U.S. national stage entry of PCT Application No. PCT/US2019/013277, filed Jan. 11, 2019, which claims the benefit of and priority to U.S. Provisional Patent Application Ser. No. 62/680,245, filed Jun. 4, 2018, the disclosures of which are incorporated herein by reference in their entireties.

GOVERNMENT RIGHTS

This invention was made with government support under CHE1531823 awarded by the National Science Foundation. The United States Government has certain rights in the invention.

TECHNICAL FIELD

The present disclosure relates generally to charge detection mass spectrometry instruments, and more specifically to performing mass and charge measurements with such instruments.

BACKGROUND

Mass Spectrometry provides for the identification of chemical components of a substance by separating gaseous ions of the substance according to ion mass and charge. Various instruments and techniques have been developed for determining the masses of such separated ions, and one such technique is known as charge detection mass spectrometry (CDMS). In CDMS, ion mass is determined for each ion individually as a function of measured ion mass-to-charge ratio, typically referred to as "m/z," and measured ion charge.

High levels of uncertainty in m/z and charge measurements with early CDMS detectors has led to the development of an electrostatic linear ion trap (ELIT) detector in which ions are made to oscillate back and forth through a charge detection cylinder. Multiple passes of ions through such a charge detection cylinder provides for multiple measurements for each ion, and it has been shown that the uncertainty in charge measurements decreases with $n^{1/2}$, where n is the number of charge measurements.

Because CDMS is conventionally a single-particle approach in which mass is determined directly for each ion, single ions are trapped and made to oscillate within the ELIT. Conditions for single-ion trapping events are tightly constrained, however, since most ion trapping events will be empty if the incoming ion signal intensity is too low and multiple ions will be trapped if the incoming ion signal intensity is too high. Moreover, because analysis of the measurements collected for each ion in conventional CDMS systems takes substantially longer than the collection time, the analysis process typically takes place off-line; e.g., overnight or at some other time displaced from the ion measurement and collection process. As a result, it is typically not known whether the ion trapping events are empty or contain multiple ions until well after ion measurements have been made. Accordingly, it is desirable to seek improvements in such CDMS systems and techniques.

SUMMARY

The present disclosure may comprise one or more of the features recited in the attached claims, and/or one or more of the following features and combinations thereof. In one aspect, a charge detection mass spectrometer may comprise an electrostatic linear ion trap (ELIT) or orbitrap, a source of ions configured to supply ions to the ELIT or orbitrap, at least one amplifier having an input operatively coupled to the ELIT or orbitrap, at least one processor operatively coupled to the ELIT or orbitrap and to an output of the at least one amplifier, and at least one memory having instructions stored therein which, when executed by the at least one processor, cause the at least one processor to (i) control the ELIT or orbitrap as part of an ion trapping event to attempt to trap therein a single ion supplied by the ion source, (ii) record ion measurement information based on output signals produced by the at least one amplifier over a duration of the ion trapping event, (iii) determine, based on the recorded ion measurement information, whether the control of the ELIT or orbitrap resulted in trapping therein of a single ion, of no ion or of multiple ions, and (iv) compute at least one of an ion mass and an ion mass-to-charge ratio based on the recorded ion measurement information only if a single ion was trapped in the ELIT or orbitrap during the trapping event.

In another aspect, a method is provided for operating a charge detection mass spectrometer including an electrostatic linear ion trap (ELIT) or orbitrap, a source of ions configured to supply ions to the ELIT or orbitrap, and at least one amplifier having an input operatively coupled to the ELIT or orbitrap. The method may comprise: with a processor, controlling the ELIT or orbitrap as part of an ion trapping event to attempt to trap therein a single ion supplied by the ion source, recording, with the processor, ion measurement information based on output signals produced by the at least one amplifier over a duration of the ion trapping event, based on the recorded ion measurement information, determining with the processor whether the control of the ELIT or orbitrap resulted in trapping therein of a single ion, of no ion or of multiple ions, and computing at least one of an ion mass and an ion mass-to-charge ratio based on the recorded ion measurement information only if a single ion was trapped in the ELIT or orbitrap during the trapping event.

In yet another aspect, a charge detection mass spectrometer may comprise an electrostatic linear ion trap (ELIT) or orbitrap, a source of ions configured to supply ions to the ELIT or orbitrap, means for controlling operation of the ELIT or orbitrap, at least one processor operatively coupled to ELIT or orbitrap and to the means for controlling the ELIT or orbitrap, a display monitor coupled to the at least one processor, and at least one memory having instructions stored therein which, when executed by the at least one processor, cause the at least one processor to (i) execute a control graphic user interface (GUI) application, (ii) produce a control GUI of the control GUI application on the display monitor, the control GUI including at least one selectable GUI element for at least one corresponding operating parameter of the ELIT or orbitrap, (iii) receive a first user command, via user interaction with the control GUI, corresponding to selection of the at least one selectable GUI element, and (iv) control the means for controlling operation of the ELIT or orbitrap to control the at least one corresponding operating parameter of the ELIT or orbitrap in response to receipt of the first user command.

In still another aspect, a charge detection mass spectrometer may comprise an electrostatic linear ion trap (ELIT) or orbitrap, a source of ions configured to supply ions to the ELIT or orbitrap, an ion intensity or flow control apparatus disposed between the source of ions and the ELIT or orbitrap, at least one processor operatively coupled to ELIT or orbitrap and to the ion intensity or flow control apparatus, and at least one memory having instructions stored therein which, when executed by the at least one processor, cause the at least one processor to (i) control the ELIT or orbitrap as part of each of multiple consecutive trapping events to attempt to trap therein a single ion from the ion source, (ii) for each of the multiple consecutive trapping events, determine whether the trapping event trapped a single ion, no ion or multiple ions in the ELIT or orbitrap, and (iii) selectively control the ion intensity or flow control apparatus to control an intensity or flow of ions from the source of ions into the ELIT or orbitrap in a manner which, over the course of the multiple consecutive trapping events, minimizes occurrences of no ion and multiple ion trapping events relative to occurrences of single ion trapping events so as to maximize occurrences of the single ion trapping events.

In a further aspect, a charge detection mass spectrometer may comprise an electrostatic linear ion trap (ELIT) or orbitrap, a source of ions configured to supply ions to the ELIT or orbitrap, at least one amplifier operatively coupled to the ELIT or orbitrap, a mass-to-charge filter disposed between the source of ions and the ELIT or orbitrap, at least one processor operatively coupled to ELIT or orbitrap and to the at least one amplifier, and at least one memory having instructions stored therein which, when executed by the at least one processor, cause the at least one processor to (i) control the mass-to-charge filter to cause only ions within a selected mass-to-charge ratio or range of mass-to-charge ratios to flow from the source of ions into the ELIT or orbitrap, (ii) control the ELIT or orbitrap as part of each of the multiple consecutive trapping events to attempt to trap therein a single ion supplied by the mass-to-charge filter, (iii) for each of the multiple consecutive trapping events, determine from ion measurement information produced by the at least one amplifier over a duration of the trapping event whether the trapping event is a single ion trapping event, a no ion trapping event or a multiple ion trapping event, and (iv) for each of the multiple consecutive trapping events, compute ion distribution information in the form of at least one of an ion mass and an ion mass-to-charge ratio from the ion measurement information only if the ion trapping event is determined to be a single ion trapping event, whereby the computed ion distribution information includes information only for ions with the selected mass-to-charge ratio or within the selected mass-to-charge ratio range.

In still a further aspect, a system for separating ions may comprise an ion source configured to generate ions from a sample, a first mass spectrometer configured to separate the generated ions as a function of mass-to-charge ratio, an ion dissociation stage positioned to receive ions exiting the first mass spectrometer and configured to dissociate ions exiting the first mass spectrometer, a second mass spectrometer configured to separate dissociated ions exiting the ion dissociation stage as a function of mass-to-charge ratio, and the charge detection mass spectrometer (CDMS) of any one or combination of the above-described aspects coupled in parallel with and to the ion dissociation stage such that the CDMS can receive ions exiting either of the first mass spectrometer and the ion dissociation stage, wherein masses of precursor ions exiting the first mass spectrometer are measured using CDMS, mass-to-charge ratios of dissociated ions of precursor ions having mass values below a threshold mass are measured using the second mass spectrometer, and mass-to-charge ratios and charge values of dissociated ions of precursor ions having mass values at or above the threshold mass are measured using the CDMS.

BRIEF DESCRIPTION OF THE DRAWINGS

FIG. 3 is a simplified diagram of an embodiment of the processor illustrated in FIG. 1.

FIGS. 4A-4C are simplified diagrams of the ELIT of FIG. 1 demonstrating sequential control and operation of the ion mirrors and of the charge generator to capture at least one ion within the ELIT and to cause the ion(s) to oscillate back and forth between the ion mirrors and through the charge detection cylinder to measure and record multiple charge detection events.

FIG. 6B is a diagrammatic illustration of an example collection of output data resulting from the real-time analysis of ion measurement event data produced by a CDMS instrument.

DESCRIPTION OF THE ILLUSTRATIVE EMBODIMENTS

For the purposes of promoting an understanding of the principles of this disclosure, reference will now be made to a number of illustrative embodiments shown in the attached drawings and specific language will be used to describe the same.

This disclosure relates to apparatuses and techniques for controlling, in real-time, operation of a charge detection mass spectrometer (CDMS) including an electrostatic linear ion trap (ELIT) for measuring and determining ion charge, mass-to-charge and mass. For purposes of this disclosure, the phrase "charge detection event" is defined as detection of a charge induced on a charge detector of the ELIT by an ion passing a single time through the charge detector, and the phrase "ion measurement event" is defined as a collection of charge detection events resulting from oscillation of an ion back and forth through the charge detector a selected number of times or for a selected time period. As the oscillation of an ion back and forth through the charge detector results from controlled trapping of the ion within the ELIT, as will be described in detail below, the phrase "ion measurement event" may alternatively be referred to herein as an "ion trapping event" or simply as a "trapping event," and the phrases "ion measurement event," "ion trapping event", "trapping event" and variants thereof shall be understood to be synonymous with one another.

Figure 1:
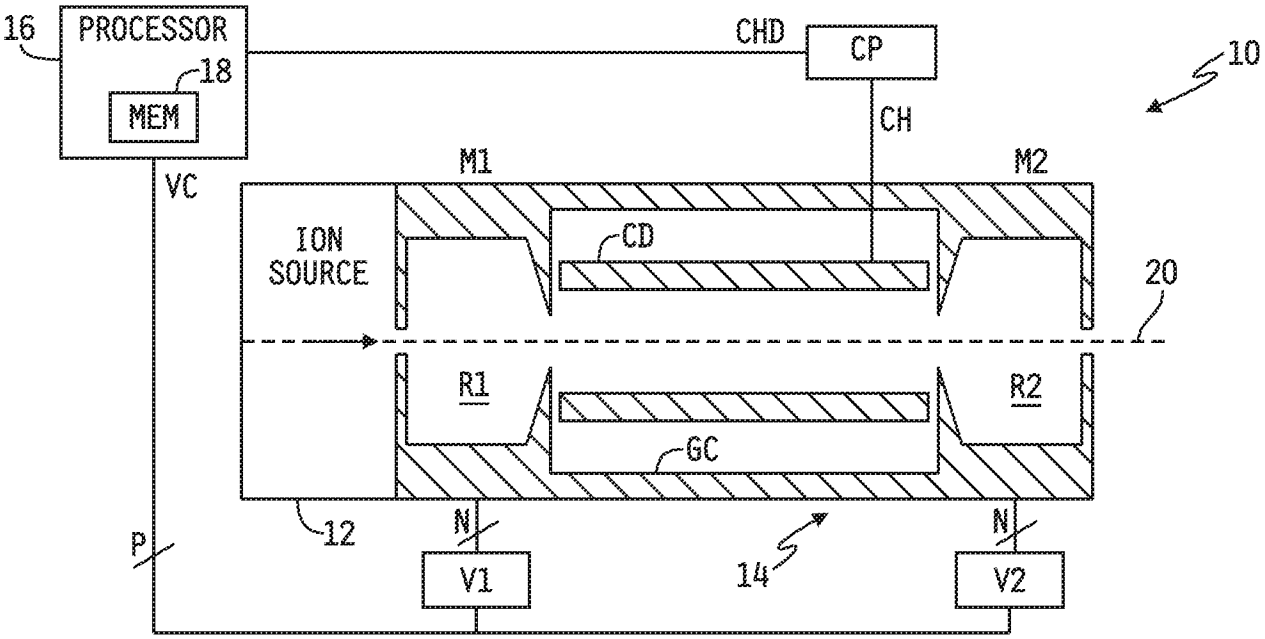
FIG. 1 is a simplified diagram of a CDMS system including an embodiment of an electrostatic linear ion trap (ELIT) with control and measurement components coupled thereto.

Referring to FIG. 1, a CDMS system 10 is shown including an embodiment of an electrostatic linear ion trap (ELIT) 14 with control and measurement components coupled thereto. In the illustrated embodiment, the CDMS system 10 includes an ion source 12 operatively coupled to an inlet of the ELIT 14. As will be described further with respect to FIG. 10A, the ion source 12 illustratively includes any conventional device or apparatus for generating ions from a sample and may further include one or more devices and/or instruments for separating, collecting, filtering, fragmenting and/or normalizing or shifting charge states of ions according to one or more molecular characteristics. As one illustrative example, which should not be considered to be limiting in any way, the ion source 12 may include a conventional electrospray ionization source, a matrix-assisted laser desorption ionization (MALDI) source or the like, coupled to an inlet of a conventional mass spectrometer. The mass spectrometer may be of any conventional design including, for example, but not limited to a time-of-flight (TOF) mass spectrometer, a reflectron mass spectrometer, a Fourier transform ion cyclotron resonance (FTICR) mass spectrometer, a quadrupole mass spectrometer, a triple quadrupole mass spectrometer, a magnetic sector mass spectrometer, or the like. In any case, the ion outlet of the mass spectrometer is operatively coupled to an ion inlet of the ELIT 14. The sample from which the ions are generated may be any biological or other material. In some embodiments, the CDMS system 10 may include an orbitrap in place of, or in addition to, the ELIT 14.

In the illustrated embodiment, the ELIT 14 illustratively includes a charge detector CD surrounded by a ground chamber or cylinder GC and operatively coupled to opposing ion mirrors M1, M2 respectively positioned at opposite ends thereof. The ion mirror M1 is operatively positioned between the ion source 12 and one end of the charge detector CD, and ion mirror M2 is operatively positioned at the opposite end of the charge detector CD. Each ion mirror M1, M2 defines a respective ion mirror region R1, R2 therein. The regions R1, R2 of the ion mirrors M1, M2, the charge detector CD, and the spaces between the charge detector CD and the ion mirrors M1, M2 together define a longitudinal axis 20 centrally therethrough which illustratively represents an ideal ion travel path through the ELIT 14 and between the ion mirrors M1, M2 as will be described in greater detail below.

In the illustrated embodiment, voltage sources V1, V2 are electrically connected to the ion mirrors M1, M2 respectively. Each voltage source V1, V2 illustratively includes one or more switchable DC voltage sources which may be controlled or programmed to selectively produce a number, N, programmable or controllable voltages, wherein N may be any positive integer. Illustrative examples of such voltages will be described below with respect to FIGS. 2A and 2B to establish one of two different operating modes of each of the ion mirrors M1, M2 as will be described in detail below. In any case, ions move within the ELIT 14 close to the longitudinal axis 20 extending centrally through the charge detector CD and the ion mirrors M1, M2 under the influence of electric fields selectively established by the voltage sources V1, V2.

The voltage sources V1, V2 are illustratively shown electrically connected by a number, P, of signal paths to a conventional processor 16 including a memory 18 having instructions stored therein which, when executed by the processor 16, cause the processor 16 to control the voltage sources V1, V2 to produce desired DC output voltages for selectively establishing ion transmission and ion reflection electric fields, TEF, REF respectively, within the regions R1, R2 of the respective ion mirrors M1, M2. P may be any positive integer. In some alternate embodiments, either or both of the voltage sources V1, V2 may be programmable to selectively produce one or more constant output voltages. In other alternative embodiments, either or both of the voltage sources V1, V2 may be configured to produce one or more time-varying output voltages of any desired shape. It will be understood that more or fewer voltage sources may be electrically connected to the mirrors M1, M2 in alternate embodiments.

The charge detector CD is illustratively provided in the form of an electrically conductive cylinder which is electrically connected to a signal input of a charge sensitive preamplifier CP, and the signal output of the charge preamplifier CP is electrically connected to the processor 16. The voltage sources V1, V2 are illustratively controlled in a manner, as described in detail below, which selectively traps an ion entering the ELIT 14 and causes it to oscillate therein back and forth between the ion mirrors M1, M2 such that the trapped ion repeatedly passes through the charge detector CD. With an ion trapped within the ELIT 14 and oscillating back and forth between the ion mirrors M1, M2, the charge preamplifier CP is illustratively operable in a conventional manner to detect charges (CH) induced on the charge detection cylinder CD as the ion passes through the charge detection cylinder CD between the ion mirrors M1, M2, to produce charge detection signals (CHD) corresponding thereto. The charge detection signals CHD are illustratively recorded in the form of oscillation period values and, in this regard, each oscillation period value represents ion measurement information for a single, respective charge detection event. A plurality of such oscillation period values are measured and recorded for the trapped ion during a respective ion measurement event (i.e., during an ion trapping event), and the resulting plurality of recorded oscillation period values i.e., the collection of recorded ion measurement information, for the ion measurement event, is processed to determine ion charge, mass-to-charge ratio and/or mass values as will be described in detail below. Multiple ion measurement events are processed in this manner, and a mass-to-charge ratio and/or mass spectrum of the sample is illustratively constructed in real time as will also be described in detail below.

Figure 2A:
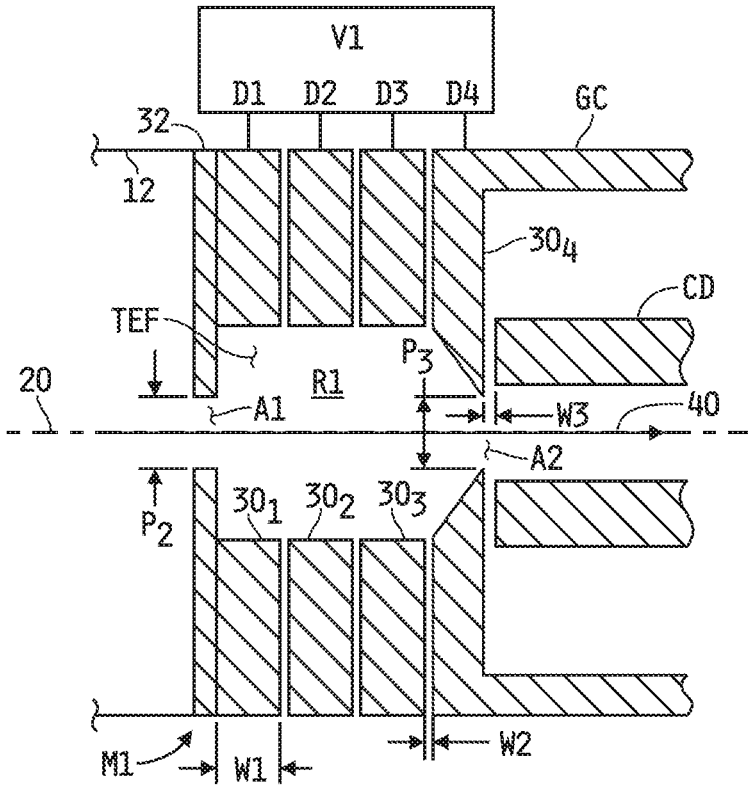
FIG. 2A is a magnified view of the ion mirror M1 of the ELIT illustrated in FIG. 1 in which the mirror electrodes of M1 are controlled to produce an ion transmission electric field therein.
Figure 2B:
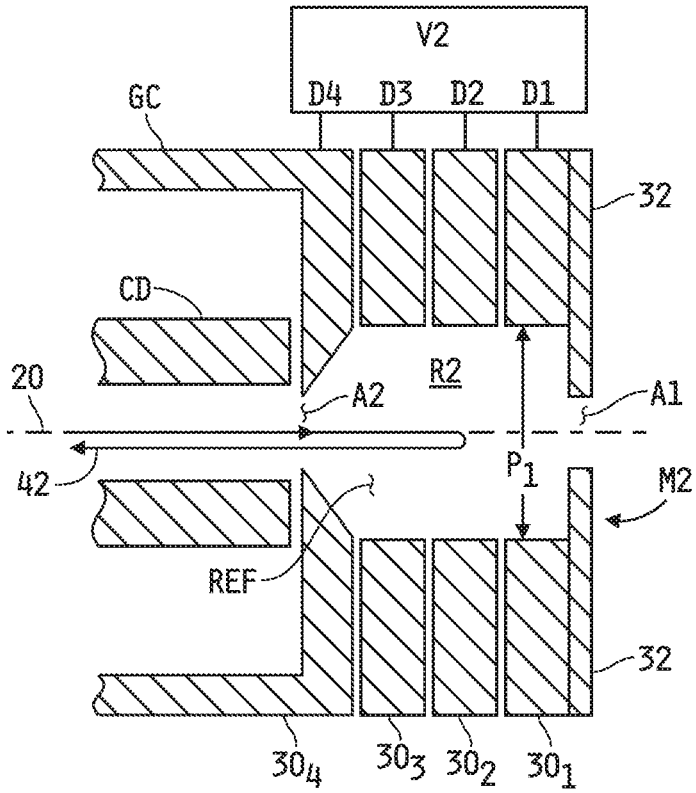
FIG. 2B is a magnified view of the ion mirror M2 of the ELIT illustrated in FIG. 1 in which the mirror electrodes of M2 are controlled to produce an ion reflection electric field therein.

Referring now to FIGS. 2A and 2B, embodiments are shown of the ion mirrors M1, M2 respectively of the ELIT 14 depicted in FIG. 1. Illustratively, the ion mirrors M1, M2 are identical to one another in that each includes a cascaded arrangement of 4 spaced-apart, electrically conductive mirror electrodes. For each of the ion mirrors M1, M2, a first mirror electrode $\mathbf{30}_1$ has a thickness W1 and defines a passageway centrally therethrough of diameter P1. An endcap 32 is affixed or otherwise coupled to an outer surface of the first mirror electrode $\mathbf{30}_1$ and defines an aperture A1 centrally therethrough which serves as an ion entrance and/or exit to and/or from the corresponding ion mirror M1, M2 respectively. In the case of the ion mirror M1, the endcap 32 is coupled to, or is part of, an ion exit of the ion source 12 illustrated in FIG. 1. The aperture A1 for each endcap 32 illustratively has a diameter P2.

A second mirror electrode $\mathbf{30}_2$ of each ion mirror M1, M2 is spaced apart from the first mirror electrode $\mathbf{30}_1$ by a space having width W2. The second mirror electrode $\mathbf{30}_2$, like the mirror electrode $\mathbf{30}_1$, has thickness W1 and defines a passageway centrally therethrough of diameter P2. A third mirror electrode $\mathbf{30}_3$ of each ion mirror M1, M2 is likewise spaced apart from the second mirror electrode $\mathbf{30}_2$ by a space of width W2. The third mirror electrode $\mathbf{30}_3$ has thickness W1 and defines a passageway centrally therethrough of width P1.

A fourth mirror electrode $\mathbf{30}_4$ is spaced apart from the third mirror electrode $\mathbf{30}_3$ by a space of width W2. The fourth mirror electrode $\mathbf{30}_4$ illustratively has a thickness of W1 and is formed by a respective end of the ground cylinder, GC disposed about the charge detector CD. The fourth mirror electrode $\mathbf{30}_4$ defines an aperture A2 centrally therethrough which is illustratively conical in shape and increases linearly between the internal and external faces of the ground cylinder GC from a diameter P3 defined at the internal face of the ground cylinder GC to the diameter P1 at the external face of the ground cylinder GC (which is also the internal face of the respective ion mirror M1, M2).

The spaces defined between the mirror electrodes $\mathbf{30}_1$-$\mathbf{30}_4$ may be voids in some embodiments, i.e., vacuum gaps, and in other embodiments such spaces may be filled with one or more electrically non-conductive, e.g., dielectric, materials. The mirror electrodes $\mathbf{30}_1$-$\mathbf{30}_4$ and the endcaps 32 are axially aligned, i.e., collinear, such that a longitudinal axis 22 passes centrally through each aligned passageway and also centrally through the apertures A1, A2. In embodiments in which the spaces between the mirror electrodes $\mathbf{30}_1$-$\mathbf{30}_4$ include one or more electrically non-conductive materials, such materials will likewise define respective passageways therethrough which are axially aligned, i.e., collinear, with the passageways defined through the mirror electrodes $\mathbf{30}_1$-$\mathbf{30}_4$ and which illustratively have diameters of P2 or greater. Illustratively, P1>P3>P2, although in other embodiments other relative diameter arrangements are possible.

A region R1 is defined between the apertures A1, A2 of the ion mirror M1, and another region R2 is likewise defined between the apertures A1, A2 of the ion mirror M2. The regions R1, R2 are illustratively identical to one another in shape and in volume.

As described above, the charge detector CD is illustratively provided in the form of an elongated, electrically conductive cylinder positioned and spaced apart between corresponding ones of the ion mirrors M1, M2 by a space of width W3. In on embodiment, W1>W3>W2, and P1>P3>P2, although in alternate embodiments other relative width arrangements are possible. In any case, the longitudinal axis 20 illustratively extends centrally through the passageway defined through the charge detection cylinder CD, such that the longitudinal axis 20 extends centrally through the combination of the ion mirrors M1, M2 and the charge detection cylinder CD. In operation, the ground cylinder GC is illustratively controlled to ground potential such that the fourth mirror electrode $\mathbf{30}_4$ of each ion mirror M1, M2 is at ground potential at all times. In some alternate embodiments, the fourth mirror electrode $\mathbf{30}_4$ of either or both of the ion mirrors M1, M2 may be set to any desired DC reference potential, or to a switchable DC or other time-varying voltage source.

In the embodiment illustrated in FIGS. 2A and 2B, the voltage sources V1, V2 are each configured to each produce four DC voltages D1-D4, and to supply the voltages D1-D4 to a respective one of the mirror electrodes $\mathbf{30}_1$-$\mathbf{30}_4$ of the respective ion mirror M1, M2. In some embodiments in which one or more of the mirror electrodes $\mathbf{30}_1$-$\mathbf{30}_4$ is to be held at ground potential at all times, the one or more such mirror electrodes $\mathbf{30}_1$-$\mathbf{30}_4$ may alternatively be electrically connected to the ground reference of the respective voltage supply V1, V2 and the corresponding one or more voltage outputs D1-D4 may be omitted. Alternatively or additionally, in embodiments in which any two or more of the mirror electrodes $\mathbf{30}_1$-$\mathbf{30}_4$ are to be controlled to the same non-zero DC values, any such two or more mirror electrodes $\mathbf{30}_1$-$\mathbf{30}_4$ may be electrically connected to a single one of the voltage outputs D1-D4 and superfluous ones of the output voltages D1-D4 may be omitted.

Each ion mirror M1, M2 is illustratively controllable and switchable, by selective application of the voltages D1-D4, between an ion transmission mode (FIG. 2A) in which the voltages D1-D4 produced by the respective voltage source V1, V2 establishes an ion transmission electric field (TEF) in the respective region R1, R2 thereof, and an ion reflection mode (FIG. 2B) in which the voltages D1-D4 produced by the respect voltage source V1, V2 establishes an ion reflection electric field (REF) in the respective region R1, R2 thereof. As illustrated by example in FIG. 2A, once an ion from the ion source 12 flies into the region R1 of the ion mirror M1 through the inlet aperture A1 of the ion mirror M1, the ion is focused toward the longitudinal axis 20 of the ELIT 14 by an ion transmission electric field TEF established in the region R1 of the ion mirror M1 via selective control of the voltages D1-D4 of V1. As a result of the focusing effect of the transmission electric field TEF in the region R1 of the ion mirror M1, the ion exiting the region R1 of the ion mirror M1 through the aperture A2 of the ground chamber GC attains a narrow trajectory into and through the charge detector CD, i.e., so as to maintain a path of ion travel through the charge detector CD that is close to the longitudinal axis 20. An identical ion transmission electric field TEF may be selectively established within the region R2 of the ion mirror M2 via like control of the voltages D1-D4 of the voltage source V2. In the ion transmission mode, an ion entering the region R2 from the charge detection cylinder CD via the aperture A2 of M2 is focused toward the longitudinal axis 20 by the ion transmission electric field TEF within the region R2 so that the ion exits the aperture A1 of the ion mirror M2.

As illustrated by example in FIG. 2B, an ion reflection electric field REF established in the region R2 of the ion mirror M2 via selective control of the voltages D1-D4 of V2 acts to decelerate and stop an ion entering the ion region R2 from the charge detection cylinder CD via the ion inlet aperture A2 of M2, to accelerate the stopped ion in the opposite direction back through the aperture A2 of M2 and into the end of the charge detection cylinder CD adjacent to M2 as depicted by the ion trajectory 42, and to focus the ion toward the central, longitudinal axis 20 within the region R2 of the ion mirror M2 so as to maintain a narrow trajectory of the ion back through the charge detector CD toward the ion mirror M1. An identical ion reflection electric field REF may be selectively established within the region R1 of the ion mirror M1 via like control of the voltages D1-D4 of the voltage source V1. In the ion reflection mode, an ion entering the region R1 from the charge detection cylinder CD via the aperture A2 of M1 is decelerated and stopped by the ion reflection electric field REF established within the region R1, then accelerated in the opposite direction back through the aperture A2 of M1 and into the end of the charge detection cylinder CD adjacent to M1, and focused toward the central, longitudinal axis 20 within the region R1 of the ion mirror M1 so as to maintain a narrow trajectory of the ion back through the charge detector CD toward the ion mirror M1. An ion that traverses the length of the ELIT 14 and is reflected by the ion reflection electric field REF in the ion regions R1, R2 in a manner that enables the ion to continue traveling back and forth through the charge detection cylinder CD between the ion mirrors M1, M2 as just described is considered to be trapped within the ELIT 14.

Example sets of output voltages D1-D4 produced by the voltage sources V1, V2 respectively to control a respective ion mirrors M1, M2 to the ion transmission and reflection modes described above are shown in TABLE I below. It will be understood that the following values of D1-D4 are provided only by way of example, and that other values of one or more of D1-D4 may alternatively be used.

TABLE I

| Ion Mirror Operating Mode | Output Voltages (volts DC) |
|---|---|
| Transmission | V1: D1 = 0, D2 = 95, D3 = 135, D4 = 0 |
| | V2: D1 = 0, D2 = 95, D3 = 135, D4 = 0 |
| Reflection | V1: D1 = 190, D2 = 125, D3 = 135, D4 = 0 |
| | V2: D1 = 190, D2 = 125, D3 = 135, D4 = 0 |

While the ion mirrors M1, M2 and the charge detection cylinder CD are illustrated in FIGS. 1-2B as defining cylindrical passageways therethrough, it will be understood that in alternate embodiments either or both of the ion mirrors M1, M2 and/or the charge detection cylinder CD may define non-cylindrical passageways therethrough such that one or more of the passageway(s) through which the longitudinal axis 20 centrally passes represents a cross-sectional area and profile that is not circular. In still other embodiments, regardless of the shape of the cross-sectional profiles, the cross-sectional areas of the passageway defined through the ion mirror M1 may be different from the passageway defined through the ion mirror M2.

Referring now to FIG. 3, an embodiment is shown of the processor 16 illustrated in FIG. 1. In the illustrated embodiment, the processor 16 includes a conventional amplifier circuit 40 having an input receiving the charge detection signal CHD produced by the charge preamplifier CP and an output electrically connected to an input of a conventional Analog-to-Digital (A/D) converter 42. An output of the A/D converter 42 is electrically connected to a first processor 50 (P1). The amplifier 40 is operable in a conventional manner to amplify the charge detection signal CHD produced by the charge preamplifier CP, and the A/D converter is, in turn, operable in a conventional manner to convert the amplified charge detection signal to a digital charge detection signal CDS. The processor 50 is, in the illustrated embodiment, operable to receive the charge detection signal CDS for each charge detection event and to pass the associated charge and timing measurement data for each such event to a downstream processor 52 for real-time analysis as will be described in detail below.

The processor 16 illustrated in FIG. 3 further includes a conventional comparator 44 having a first input receiving the charge detection signal CHD produced by the charge preamplifier CP, a second input receiving a threshold voltage CTH produced by a threshold voltage generator (TG) 46 and an output electrically connected to the processor 50. The comparator 44 is operable in a conventional manner to produce a trigger signal TR at the output thereof which is dependent upon the magnitude of the charge detection signal CDH relative to the magnitude of the threshold voltage CTH. In one embodiment, for example, the comparator 44 is operable to produce an "inactive" trigger signal TR at or near a reference voltage, e.g., ground potential, as long as CHD is less than CTH, and is operable to produce an "active" TR signal at or near a supply voltage of the circuitry 40, 42, 44, 46, 50 or otherwise distinguishable from the inactive TR signal when CHD is at or exceeds CTH. In alternate embodiments, the comparator 44 may be operable to produce an "inactive" trigger signal TR at or near the supply voltage as long as CHD is less than CTH, and is operable to produce an "active" trigger signal TR at or near the reference potential when CHD is at or exceeds CTH. Those skilled in the art will recognize other differing trigger signal magnitudes and/or differing trigger signal polarities that may be used to establish the "inactive" and "active" states of the trigger signal TR so long as such differing trigger signal magnitudes and/or different trigger signal polarities are distinguishable by the processor 50, and it will be understood that any such other different trigger signal magnitudes and/or differing trigger signal polarities are intended to fall within the scope of this disclosure. In any case, the comparator 44 may additionally be designed in a conventional manner to include a desired amount of hysteresis to prevent rapid switching of the output between the reference and supply voltages.

The processor 50 is illustratively operable to produce a threshold voltage control signal THC and to supply THC to the threshold generator 46 to control operation thereof. In some embodiments, the processor 50 is programmed or programmable to control production of the threshold voltage control signal THC in a manner which controls the threshold voltage generator 46 to produce CTH with a desired magnitude and/or polarity. In other embodiments, a user may provide the processor 50 with instructions in real time, e.g., through a downstream processor 52 via a virtual control and visualization unit 56 as described below, to control production of the threshold voltage control signal THC in a manner which controls, likewise in real time, the threshold voltage generator 46 to produce CTH with a desired magnitude and/or polarity. In either case, the threshold voltage generator 46 is illustratively implemented, in some embodiments, in the form of a conventional controllable DC voltage source configured to be responsive to a digital form of the threshold control signal THC, e.g., in the form of a single serial digital signal or multiple parallel digital signals, to produce an analog threshold voltage CTH having a polarity and a magnitude defined by the digital threshold control signal THC. In some alternate embodiments, the threshold voltage generator 46 may be provided in the form of a conventional digital-to-analog (D/A) converter responsive to a serial or parallel digital threshold voltage TCH to produce an analog threshold voltage CTH having a magnitude, and in some embodiments a polarity, defined by the digital threshold control signals THC. In some such embodiments, the D/A converter may form part of the processor 50. Those skilled in the art will recognize other conventional circuits and techniques for selectively producing the threshold voltage CTH of desired magnitude and/or polarity in response to one or more digital and/or analog forms of the control signal THC, and it will be understood that any such other conventional circuits and/or techniques are intended to fall within the scope of this disclosure.

In addition to the foregoing functions performed by the processor 50, the processor 50 is further operable to control the voltage sources V1, V2 as described above with respect to FIGS. 2A, 2B to selectively establish ion transmission and reflection fields within the regions R1, R2 of the ion mirrors M1, M2 respectively. In some embodiments, the processor 50 is programmed or programmable to control the voltage sources V1, V2. In other embodiments, the voltage source(s) V1 and/or V2 may be programmed or otherwise controlled in real time by a user, e.g., through a downstream processor 52 via a virtual control and visualization unit 56 as described below. In either case, the processor 50 is, in one embodiment, illustratively provided in the form of a field programmable gate array (FPGA) programmed or otherwise instructed by a user to collect and store charge detection signals CDS for charge detection events and for ion measurement events, to produce the threshold control signal(s) TCH from which the magnitude and/or polarity of the threshold voltage CTH is determined or derived, and to control the voltage sources V1, V2. In this embodiment, the memory 18 described with respect to FIG. 1 is integrated into, and forms part of, the programming of the FPGA. In alternate embodiments, the processor 50 may be provided in the form of one or more conventional microprocessors or controllers and one or more accompanying memory units having instructions stored therein which, when executed by the one or more microprocessors or controllers, cause the one or more microprocessors or controllers to operate as just described. In other alternate embodiments, the processing circuit 50 may be implemented purely in the form of one or more conventional hardware circuits designed to operate as described above, or as a combination of one or more such hardware circuits and at least one microprocessor or controller operable to execute instructions stored in memory to operate as described above.

The embodiment of the processor 16 depicted in FIG. 3 further illustratively includes a second processor 52 coupled to the first processor 50 and also to at least one memory unit 54. In some embodiments, the processor 52 may include one or more peripheral devices, such as a display monitor, one or more input and/or output devices or the like, although in other embodiments the processor 52 may not include any such peripheral devices. In any case, the processor 52 is illustratively configured, i.e., programmed, to execute at least one process for analyzing ion measurement events in real time, i.e., as ion measurement events are collected by the processor 50. Data in the form of charge magnitude and detection timing data received by the processor 50 via the charge detection signals CDS is illustratively transferred from the processor 50 directly to the processor 52 for processing and analysis upon completion of each ion measurement event. The processor 52 is illustratively provided in the form of a high-speed server operable to perform both collection/storage and analysis of such data. One or more high-speed memory units 54 is/are coupled to the processor 52, and is/are operable to store data received and analyzed by the processor 52. In one embodiment, the one or more memory units 54 illustratively include at least one local memory unit for storing data being used or to be used by the processor 52, and at least one permanent storage memory unit for storing datalong term.

In one embodiment, the processor 52 is illustratively provided in the form of a Linux® server (e.g., OpenSuse Leap 42.1) with four Intel® Xeon™ processors (e.g., E5-465L v2, 12 core, 2.4 GHz). In this embodiment, an improvement in the average analysis time of a single ion measurement event file of over 100× is realized as compared with a conventional Windows® PC (e.g., i5-2500K, 4 cores, 3.3 GHz). Likewise, the processor 52 of this embodiment together with high speed/high performance memory unit(s) 54 illustratively provide for an improvement of over 100× in data storage speed. Those skilled in the art will recognize one or more other high-speed data processing and analysis systems that may be implemented as the processor 52, and it will be understood that any such one or more other high-speed data processing and analysis systems are intended to fall within the scope of this disclosure.

In the illustrated embodiment, the memory unit 54, e.g., a local memory unit, illustratively has instructions stored therein which are executable by the processor 52 to provide a graphic user interface (GUI) for real-time virtual control by a user of the CDMS system 10 ("real-time control GUI"). One embodiment of such a real-time control GUI is illustrated by example in FIG. 6A and will be described in detail below. The memory unit 54 further has instructions stored therein which are executable by the processor 52 to analyze ion measurement event data in real time as it is produced by the ELIT 14 to determine ion mass spectral information for a sample under analysis ("real-time analysis process"). In one embodiment of the real-time analysis process, the processor 52 is operable to receive ion measurement event data from the processor 50 as it is collected by the processor 50, i.e., in the form of charge magnitude and charge detection timing information measured during each of multiple "charge detection events" (as this term is defined above) making up the "ion measurement event" (as this term is defined above), to create a file of such ion measurement event data as each such ion measurement event concludes, to process in real time each such created ion measurement event file to determine whether it is an empty trapping event, a single ion trapping event or a multiple ion trapping event, to process only single ion trapping event files to determine ion charge, mass-to-charge and mass data, and to create and continually update mass spectral information for the sample under analysis with new ion measurement data as it becomes available. An example embodiment of such the real-time analysis process will be described in detail with respect to FIG. 5 below.

In some embodiments, the real-time control GUI briefly described above may be managed directly from the processor 52, wherein operating parameters of the CDMS system 10 and of the ELIT 14 in particular may be selected, e.g., in real time or at any time, and output file management and display may be managed. In other embodiments, the processor 16 includes a separate processor 56 coupled to the processor 52 as illustrated by example in FIG. 3. In such embodiments, the processor 56 is illustratively a conventional processor or processing system for which widely known and used graphing utilities and data processing programs are available. In one example embodiment, the processor 56 is implemented in the form of a conventional Windows®-based personal computer (PC) including one or more such graphing utilities and data processing programs installed thereon. Those skilled in the art will recognize other conventional processors or processing systems which may be suitable for used as the processor 56, and it will be understood that any such other conventional processors or processing systems are intended to fall within the scope of this disclosure.

Figure 6A:
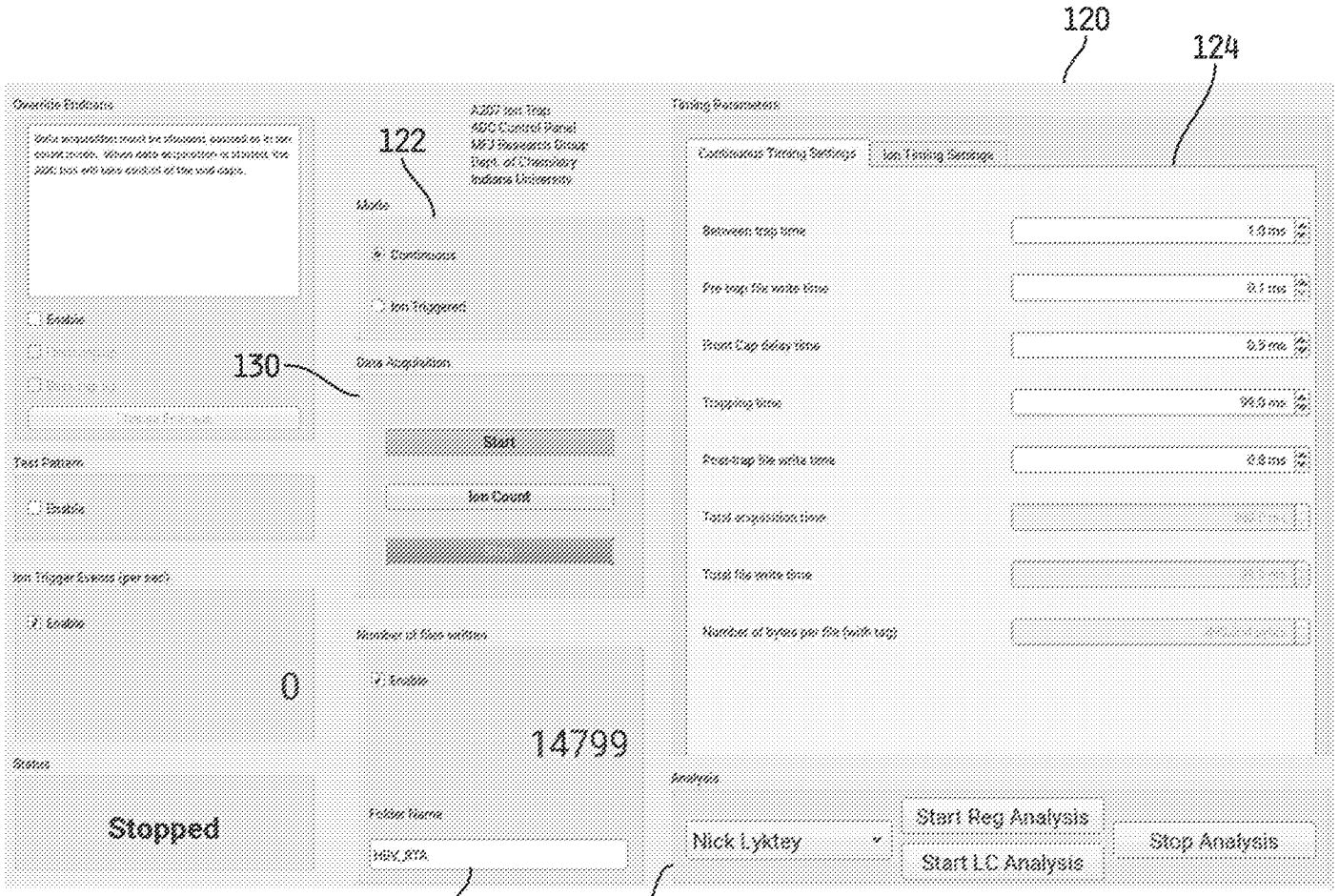
FIG. 6A is a diagrammatic illustration of an embodiment of a graphic user interface for real-time virtual control by a user of the CDMS instrument of FIG. 1.
Figure 6C:
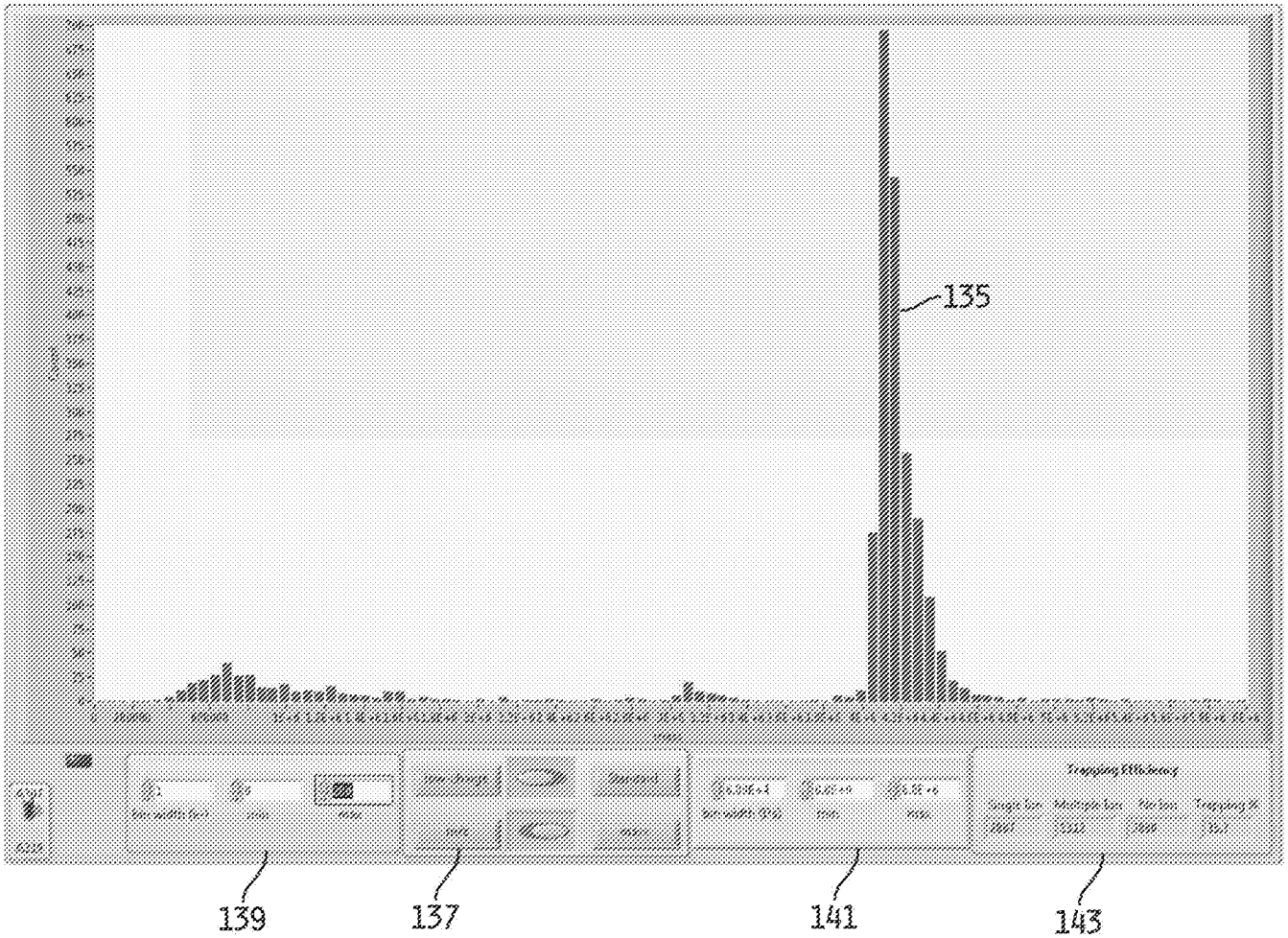
FIG. 6C is a real-time snapshot of a histogram being constructed from output data resulting from the real-time analysis of ion measurement event data as it is produced by a CDMS instrument.

In any case, in embodiments which include the processor 56, a graphical user interface (GUI), e.g., an RTA GUI, is included to provide a user-friendly and real-time control GUI which is accessible via the processor 56. In one embodiment, the real-time control GUI is stored in the memory 54 and executed by the processor 52, and the processor 56 is used to access the user GUI from the processor 52, e.g., via a secure shell (ssh) connection between the two processors 52, 56. In alternate embodiments, the real-time control GUI may be stored on and executed by the processor 56. In either case, the processor 56 illustratively acts as a virtual control and visualization (VCV) unit with which a user may visualize and control all aspects of the real time analysis process and of the real-time operation of the CDMS 10 via the real-time control GUI, and with which the user may also visualize real-time output data and spectral information produced by the CDMS instrument under control of the real-time analysis process. Example screens of one such real-time control GUI are illustrated in FIGS. 6A-6C and will be described in detail below.

As briefly described above with respect to FIGS. 2A and 2B, the voltage sources V1, V2 are illustratively controlled by the processor 50, e.g., via the processor 52 and/or via the processor 56, in a manner which selectively establishes ion transmission and ion reflection electric fields in the region R1 of the ion mirror M1 and in the region R2 of the ion mirror M2 to guide ions introduced into the ELIT 14 from the ion source 12 through the ELIT 14, and to then cause a single ion to be selectively trapped and confined within the ELIT 14 such that the trapped ion repeatedly passes through the charge detector CD as it oscillates back and forth between M1 and M2. Referring to FIGS. 4A-4C, simplified diagrams of the ELIT 14 of FIG. 1 are shown depicting an example of such sequential control and operation of the ion mirrors M1, M2 of the ELIT 14. In the following example, the processor 52 will be described as controlling the operation of the voltage sources V1, V2 in accordance with its programming, although it will be understood that the operation of the voltage source V1 and/or the operation of the voltage source V1 may be virtually controlled, at least in part, by a user via the processor 56 as briefly described above.

Figure 7A:
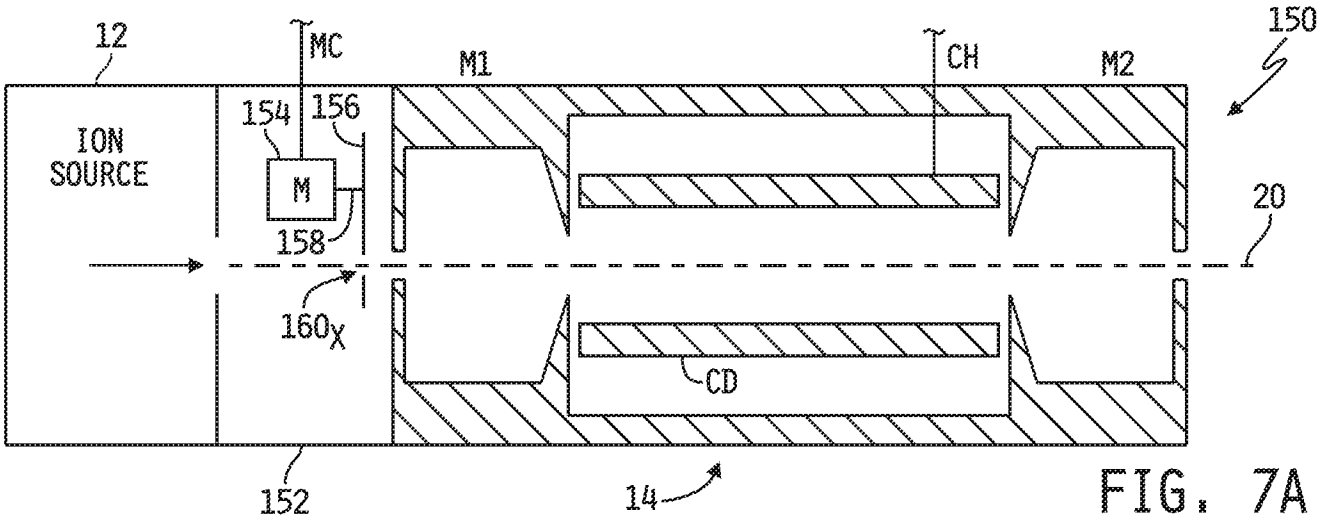
FIG. 7A is a simplified diagram of a CDMS system similar to that illustrated in FIGS. 1 and 3, and including an embodiment of an apparatus interposed between the ion source and the ELIT for controlling ion inlet conditions to optimize single-ion trapping events by the ELIT.
Figure 7B:
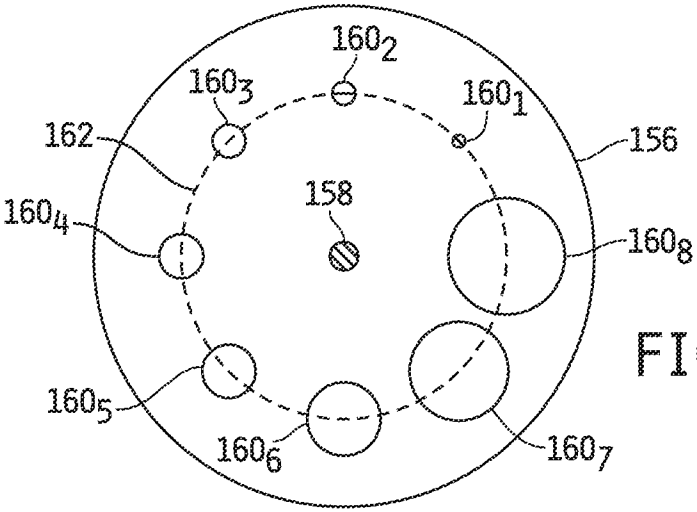
FIG. 7B is a simplified diagram of a variable aperture disk forming part of the apparatus illustrated in FIG. 7A.

As illustrated in FIG. 4A, the ELIT control sequence begins with the processor 52 controlling the voltage source V1 to control the ion mirror M1 to the ion transmission mode of operation (T) by establishing an ion transmission field within the region R1 of the ion mirror M1, and also controlling the voltage source V2 to control the ion mirror M2 to the ion transmission mode of operation (T) by likewise establishing an ion transmission field within the region R2 of the ion mirror M2. As a result, ions generated by the ion source 12 pass into the ion mirror M1 and are focused by the ion transmission field established in the region R1 toward the longitudinal axis 20 as they pass into the charge detection cylinder CD. The ions then pass through the charge detection cylinder CD and into the ion mirror M2 where the ion transmission field established within the region R2 of M2 focusses the ions toward the longitudinal axis 20 such that the ions pass through the exit aperture A1 of M2 as illustrated by the ion trajectory 60 depicted in FIG. 4A. In some embodiments, one or more operating conditions of the ELIT 14 may be controlled during the state illustrated in FIG. 4A, e.g., via the user interface described above, to control operation of the ELIT 14, some examples of which will be described below with respect to FIG. 6A. Alternatively or additionally, one or more apparatuses may be interposed between the ion source 12 and the ELIT 14 to control ion inlet conditions, as part of or separately from the state illustrated in FIG. 4A, in a manner which optimizes single ion trapping within the ELIT 14. One example of such an apparatus is illustrated in FIGS. 7A and 7B which will be described in detail below.

Referring now to FIG. 4B, after both of the ion mirrors M1, M2 have been operating in ion transmission operating mode for a selected time period and/or until successful ion transmission therethrough has been achieved, e.g., by monitoring the charge detection signals CDS captured by the processor 50 and adjusting/modifying one or more operating parameters or conditions of the ELIT 14 as needed, the processor 52 is illustratively operable to control the voltage source V2 to control the ion mirror M2 to the ion reflection mode (R) of operation by establishing an ion reflection field within the region R2 of the ion mirror M2, while maintaining the ion mirror M1 in the ion transmission mode (T) of operation as shown. As a result, at least one ion generated by the ion source 12 enters into the ion mirror M1 and is focused by the ion transmission field established in the region R1 toward the longitudinal axis 20 such that the at least one ion passes through the ion mirror M1 and into the charge detection cylinder CD as just described with respect to FIG. 4A. The ion(s) then pass(es) through the charge detection cylinder CD and into the ion mirror M2 where the ion reflection field established within the region R2 of M2 reflects the ion(s) to cause it/them to travel in the opposite direction and back into the charge detection cylinder CD, as illustrated by the ion trajectory 62 in FIG. 4B.

Referring now to FIG. 4C, after the ion reflection electric field has been established in the region R2 of the ion mirror M2, the processor 52 is operable to control the voltage source V1 to control the ion mirror M1 to the ion reflection mode (R) of operation by establishing an ion reflection field within the region R1 of the ion mirror M1, while maintaining the ion mirror M2 in the ion reflection mode (R) of operation in order to trap the ion(s) within the ELIT 14. In some embodiments, the processor 52 is illustratively operable, i.e., programmed, to control the ELIT 14 in a "random trapping mode" or "continuous trapping mode" in which the processor 52 is operable to control the ion mirror M1 to the reflection mode (R) of operation after the ELIT 14 has been operating in the state illustrated in FIG. 4B, i.e., with M1 in ion transmission mode and M2 in ion reflection mode, for a selected time period. Until the selected time period has elapsed, the ELIT 14 is controlled to operate in the state illustrated in FIG. 4B.

The probability of trapping at least one ion in the ELIT 14 is relatively low using the random trapping mode of operation due to the timed control of M1 to ion reflection mode of operation without any confirmation that at least one ion is travelling within the ELIT 14. The number of trapped ions within the ELIT 14 during the random trapping mode of operation follows a Poisson distribution and, with the ion inlet signal intensity adjusted to maximize the number of single ion trapping events, it has been shown that only about 37% of trapping events in the random trapping mode can contain a single ion. If the ion inlet signal intensity is too small, most of the trapping events will be empty, and if it is too large most will contain multiple ions.

In other embodiments, the processor 52 is operable, i.e., programmed, to control the ELIT 14 in a "trigger trapping mode" which illustratively carries a substantially greater probability of trapping a single ion therein. In a first version of the trigger trapping mode, the processor 50 is operable to monitor the trigger signal TR produced by the comparator 44 and to control the voltage source V1 to control the ion mirror M1 to the reflection mode (R) of operation to trap an ion within the ELIT 14 if/when the trigger signal TR changes the "inactive" to the "active" state thereof. In some embodiments, the processor 50 may be operable to control the voltage source V1 to control the ion mirror M1 to the reflection mode (R) immediately upon detection of the change of state of the trigger signal TR, and in other embodiments the processor 50 may be operable to control the voltage source V1 to control the ion mirror M1 to the reflection mode (R) upon expiration of a predefined or selectable delay period following detection of the change of state of the trigger signal TR. In any case, the change of state of the trigger signal TR from the "inactive" state to the "active" state thereof results from the charge detection signal CHD produced by the charge preamplifier CP reaching or exceeding the threshold voltage CTH, and therefore corresponds to detection of a charge induced on the charge detection cylinder CD by an ion contained therein. With an ion thus contained within the charge detection cylinder CD, control by the processor 50 of the voltage source V1 to control the ion mirror M1 to the reflection mode (R) of operation results in a substantially improved probability, relative to the random trapping mode, of trapping a single ion within the ELIT 14. Thus, when an ion has entered the ELIT 14 via the ion mirror M1 and is detected as either passing the first time through the charge detection cylinder CD toward the ion mirror M2 or as passing back through the charge detection cylinder CD after having been reflected by the ion reflection field established within the region R2 of the ion mirror M2 as illustrated in FIG. 4B, the ion mirror M1 is controlled to the reflection mode (R) as illustrated in FIG. 4C to trap the ion within the ELIT 14. It is also desirable to optimize the signal intensity with trigger trapping as briefly described above with respect to the random trapping mode of operation. In trigger trapping mode with optimized ion inlet signal intensity, for example, it has been shown that trapping efficiency, defined here as a ratio of single-ion trapping events and all acquired trapping events, can approach 90% as compared to 37% with random trapping. However, if the ion inlet signal intensity is too large the trapping efficiency will be less than 90% and it will be necessary to reduce the ion inlet signal intensity.

In a second version of the trigger trapping mode, the process or step illustrated in FIG. 4B is omitted or bypassed, and with the ELIT 14 operating as illustrated in FIG. 4A the processor 50 is operable to monitor the trigger signal TR produced by the comparator 44 and to control both voltage sources V1, V2 to control the respective ion mirrors M1, M2 to the reflection mode (R) of operation to trap or capture an ion within the ELIT 14 if/when the trigger signal TR changes the "inactive" to the "active" state thereof. Thus, when an ion has entered the ELIT 14 via the ion mirror M1 and is detected as passing the first time through the charge detection cylinder CD toward the ion mirror M2 as illustrated in FIG. 4A, the ion mirrors M1 and M2 are both controlled to the reflection mode (R) as illustrated in FIG. 4C to trap the ion within the ELIT 14.

In any case, with both of the ion mirrors M1, M2 controlled to the ion reflection operating mode (R) to trap an ion within the ELIT 14, the ion is caused by the opposing ion reflection fields established in the regions R1 and R2 of the ion mirrors M1 and M2 respectively to oscillate back and forth between the ion mirrors M1 and M2, each time passing through the charge detection cylinder CD as illustrated by the ion trajectory 64 depicted in FIG. 4C and as described above. In one embodiment, the processor 50 is operable to maintain the operating state illustrated in FIG. 4C until the ion passes through the charge detection cylinder CD a selected number of times. In an alternate embodiment, the processor 50 is operable to maintain the operating state illustrated in FIG. 4C for a selected time period after controlling M1 (and M2 in some embodiments) to the ion reflection mode (R) of operation. In either embodiment, the number of cycles or time spent in the state illustrated in FIG. 4C may illustratively controlled via the user interface as will be described below with respect to FIG. 6A, and in any case the ion detection event information resulting from each pass by the ion through the charge detection cylinder CD is temporarily stored in the processor 50. When the ion has passed through the charge detection cylinder CD a selected number of times or has oscillated back-and-forth between the ion mirrors M1, M2 for a selected period of time, the total number of charge detection events stored in the processor 50 defines an ion measurement event and, upon completion of the ion measurement event, the stored ion detection events defining the ion measurement event are passed to, or retrieved by, the processor 52. The sequence illustrated in FIGS. 4A-4C then returns to that illustrated in FIG. 4A where the voltage sources V1, V2 are controlled as described above to control the ion mirrors M1, M2 respectively to the ion transmission mode (T) of operation by establishing ion transmission fields within the regions R1, R2 of the ion mirrors M1, M2 respectively. The illustrated sequence then repeats for as many times as desired.

Figure 5:
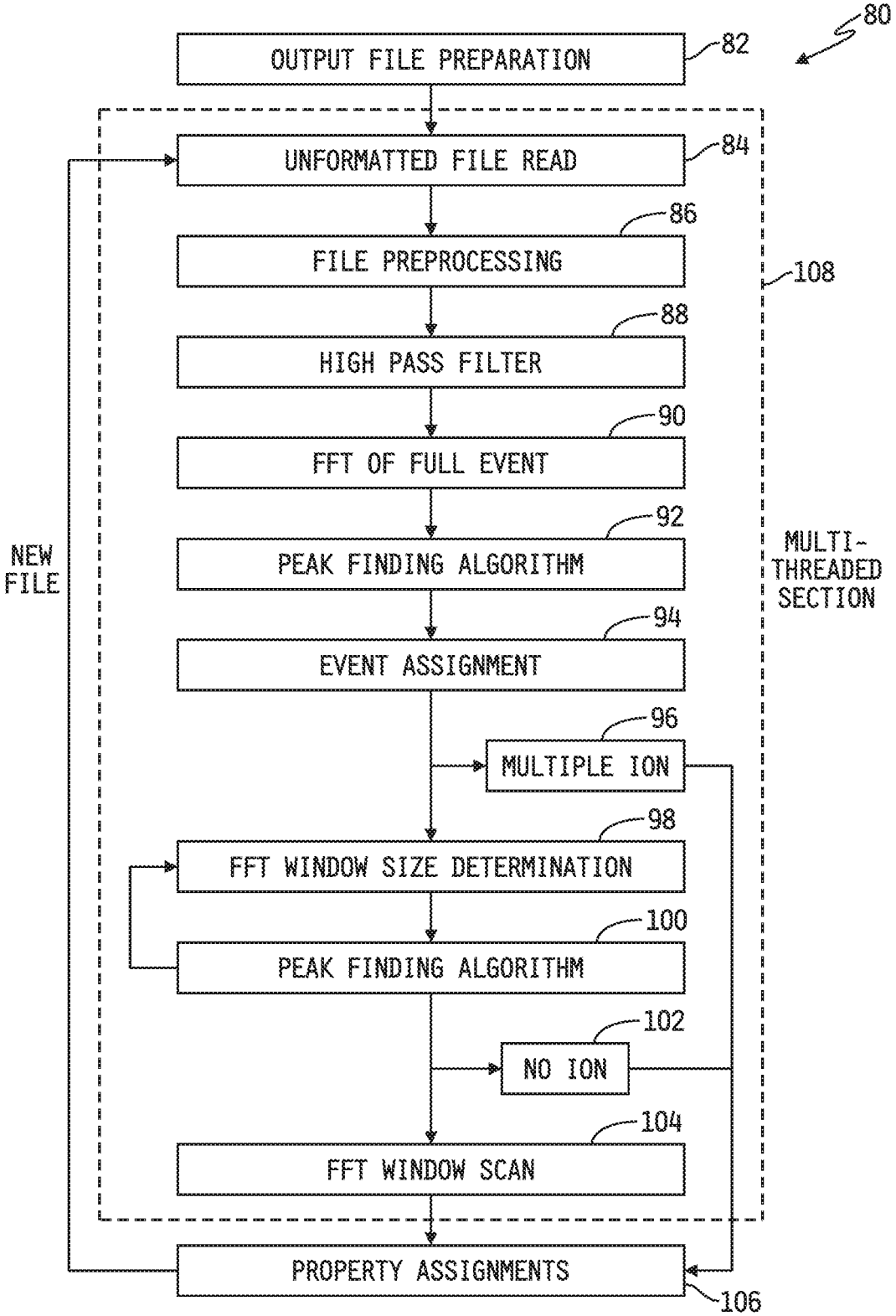
FIG. 5 is a simplified flowchart of an embodiment of a process for analyzing ion measurement event data in real time as it is produced by a CDMS instrument.

Referring now to FIG. 5, a flowchart is shown illustrating an embodiment of the real-time analysis process 80 briefly described above to continually process and analyze ion measurement event information collected by the processor 50 as it collected by the processor 50 during the repeated sequence illustrated in FIGS. 4A-4C for a given sample from which ions are produced by the ions source 12. Illustratively, the real-time analysis process 80 is stored in the memory 54 in the form of instructions which, when executed by the processor 52, causes the processor 52 to carry out the steps described below. The process 80 illustratively begins at step 82 where the processor 52 is operable to create output files in which to store charge detection event data for each of a plurality of ion measurement events to be analyzed. Thereafter, and beginning with step 84, the processor 52 is operable to receive and process each new collection of ion measurement event information from the processor 50 upon conclusion of the event as described above. At step 84, the processor 52 is operable to open a created ion measurement event file and read the unformatted ion measurement event information received from the processor 50 into an integer array.

Each ion measurement file illustratively contains charge detection data for one ion measurement event (i.e., for one ion trapping event). In some embodiments, each ion measurement file further illustratively includes short pre-trapping and post-trapping periods which contain noise induced on the charge detection cylinder CD when the voltage sources V1, V2 are switched back and forth between ion transmission and ion reflection modes as described above. Illustratively, the trapping event period can range between a few milliseconds (ms) and tens of seconds, with typical trapping event periods ranging between 10 ms and 30 seconds. With the CDMS 10 illustrated in FIGS. 1-3 and described in detail above, an example trapping event period of 100 ms may illustratively be used as this example trapping event period provides an acceptable balance between data collection speed and uncertainty in the charge determination.

In any case, the process 80 advances from step 84 to step 86 where the ion measurement file containing the unformatted ion measurement event information is pre-processed. In one embodiment, the processor 52 is operable at step 86 to pre-process the ion measurement file by truncating the integer array so as to include only ion detection event information, i.e., to remove the pre-trapping and post-trapping noise information in embodiments which include it, and then zero-padding the array to the nearest power of two for purposes of computational efficiency. As an illustrative example, in embodiments in which the trapping event period is 100 ms, completion of step 86 illustratively results in 262144 points.

Following step 86, one embodiment of the process 80 includes step 88 in which the processor 52 passes the data in the pre-processed ion measurement file through a high-pass filter to remove low frequency noise generated in and by the CDMS system 10. In embodiments in which such low frequency noise is not present or de minimis, step 88 may be omitted. Thereafter at step 90, the processor 52 is operable to compute a Fourier Transform of the data in the ion measurement file, i.e., the entire time-domain collection of charge detection events making up the ion measurement file. The processor 52 is illustratively operable to compute such a Fourier Transform using any conventional digital Fourier Transform (DFT) technique such as, for example but not limited to, a conventional Fast Fourier Transform (FFT) algorithm.

Thereafter at step 92, the resulting frequency domain spectrum is scanned for peaks. In one embodiment, a peak is defined as any magnitude which rises above a multiple, e.g., 6, of the root-mean-square-deviation (RMSD) of the noise floor. It will be understood that the multiple 6 is provided only by way of example, and that other multiples may instead be used. Moreover, those skilled in the art will recognize other suitable techniques for defining frequency domain peaks in the Fourier transformed ion measurement file data, and it will be understood that any such other suitable techniques are intended to fall within the scope of this disclosure.

Following step 92, the processor 52 is operable at step 94 to assign a trapping event identifier to the ion measurement file by processing the results of the peak-finding step 92. If no peaks were found in the peak-finding step 92, the ion measurement file is identified an empty trapping or no ion event. If peaks were found, the processor 52 is operable to identify the peak with the largest magnitude as the fundamental frequency of the frequency domain ion measurement file data. The processor 52 is then operable to process the remaining peaks relative to the fundamental peak to determine whether the remaining peaks are located at harmonic frequencies of the fundamental frequency. If not, the ion measurement file is identified as a multiple ion trapping event. If the remaining peaks are all located at harmonic frequencies of the fundamental, the ion measurement file is identified as a single ion trapping event.

Following step 94, if the ion measurement file is identified as a multiple trapping event the processor 52 is operable at step 96 to store the so-identified ion measurement file in the memory 54 (e.g., long term or permanent memory). Multiple trapping events are not included in subsequent ion mass determination steps and therefore will not contribute to the mass spectral distribution of the sample. The process 80 thus advances from step 94 to step 106.

If the ion measurement file is identified as an empty trapping event or as a single ion trapping event, the process 80 also advances from step 94 to step 98. Empty trapping event files illustratively advance to step 98 because they may in fact contain charge detection events for a weakly charged ion which may have been trapped for less than an entire ion measurement event. The magnitudes of the frequency domain peaks for such a weakly-charged ion in the full-event Fourier Transform computed at step 90 may not exceed the peak determination threshold described above, and the ion measurement file therefore may have been identified as an empty trapping event at step 94 even though the ion measurement file may nevertheless contain useful charge detection event data. The identification of the ion measurement file at step 94 as an empty trapping event thus represents a preliminary such identification, and additional processing of the file is carried out at steps 98 and 100 to determine whether the file is indeed an empty trapping event or may instead contain ion detection event information that may contribute to the mass spectral distribution of the sample.

At step 98, the processor 52 is operable to undertake a Fourier Transform windowing process in which the processor 52 computes a Fourier Transform of a small section or window of information at the beginning of the time domain charge detection data in the ion measurement file. Thereafter at step 100, the processor 52 is operable to scan the frequency domain spectrum of the Fourier Transform computed at step 98 for peaks. Illustratively, the processor 52 is operable to execute step 100 using the same peak-finding technique described above with respect to step 92, although in other embodiments one or more alternate or additional peak-finding techniques may be used at step 100. In any case, if no peak is found at step 100, the process 80 loops back to step 98 where the processor 52 is operable to increase the window size, e.g., by a predefined incremental amount, by a predefined or dynamic fraction of the size of the current window or by some other amount, and to re-compute the Fourier Transform of the new window of information at the beginning of the time domain charge detection signal data in the ion measurement file.

Steps 98 and 100 are repeatedly executed until a peak is found. If no peak is found when the window is ultimately expanded to include all of the time domain charge detection data in the ion measurement file, the ion measurement file is finally identified by the processor 52 as an empty trapping event, and the processor 52 is thereafter operable at step 102 to store the so-identified ion measurement file in the memory 54 (e.g., long term or permanent memory). Verified or confirmed empty trapping events resulting from repeated executions of steps 98 and 100 are not included in subsequent ion mass determination steps and therefore will not contribute to the mass spectral distribution of the sample. The process 80 thus advances from step 102 to step 106.

If/when a peak is found during the windowing process of steps 98 and 100, the corresponding minimum window size in which a frequency domain peak is found is noted, and the process 80 advances to step 104. In cases where a peak is found during the windowing process of an ion measurement file preliminarily identified as an empty trapping event, the ion measurement file is re-identified as a single ion trapping event and processing of this file advances to step 104.

At step 104, the processor 52 is operable to incrementally scan the minimum window size found at steps 98/100 across the time domain charge detection signal data in the ion measurement file, wherein the ion measurement file may be a file originally identified as a single ion trapping event or a file preliminarily identified as an empty trapping event but then re-identified as a single ion trapping event during execution of steps 98/100. In any case, at step 104 the processor 52 is operable at each stage of the minimum window size scan to compute a Fourier Transform of time domain charge detection information contained within the present position of the window, and to determine the oscillation frequency and magnitude of the frequency domain data within the window.

From these values, the trapping event length, the average mass-to-charge, ion charge and mass values are determined using known relationships at step 106, and these values form part of the ion measurement event file. For example, mass-to-charge is inversely proportional to the square of the fundamental frequency ff determined directly from the computed Fourier Transform, and ion charge is proportional to the magnitude of the fundamental frequency of the Fourier Transform, taking into account the number of ion oscillation cycles. In some cases, the magnitude(s) of one or more of the harmonic frequencies of the FFT may be added to the magnitude of the fundamental frequency for purposes of determining the ion charge, z. In any case, the ion mass, m, is then computed as a function of the average mass-to-charge and charge values. As depicted by example in FIG. 6C, the processor 52 illustratively constructs mass-to-charge ratio and mass spectra in real time from the ion mass and mass to charge values of each ion measurement event file as ion measurement event information becomes available and is processed by the processor 52 according to the real-time analysis process 80 as just described. In alternate embodiments, the processor 52 may be operable at step 106 to construct only a mass-to-charge spectrum or a mass spectrum. In some embodiments, only ions that remain trapped for the full ion measurement event are allowed to contribute to the mass or mass-to-charge distribution, although in other embodiments ions trapped for less than the full ion measurement event may be included in the mass or mass-to-charge distribution. As the trapping events, i.e., the ion measurements, are independent of one another, most of the data analysis steps just described can be multithreaded to minimize or at least reduce the total analysis time, as depicted by the dashed-line boundary 108 surrounding steps 84-104 FIG. 5. In any case, the process 80 illustratively loops from step 106 back to step 84 to process another ion measurement event file. Multiple, e.g., hundreds or thousands or more, ion trapping events are typically carried out for any particular sample from which the ions are generated by the ion source 12, and ion mass-to-charge, ion charge and ion mass values are determined/computed from an ion measurement event file for each such ion trapping event using the process 80 just described.

Referring now to FIG. 6A, an embodiment is shown of the real-time control GUI briefly described above with respect to FIG. 3. In the illustrated embodiment, the real-time control GUI is provided in the form of a virtual control panel 120 depicting a number of control sections each including a plurality of selectable GUI elements for controlling operation of the CDMS system 10 generally and of the ELIT 14 in particular. One such control section is a trapping mode section 122 which illustratively includes selectable GUI elements for selecting between continuous (i.e., random) trapping and trigger trapping as these trapping modes are described above. In the illustrated control panel 120, the user has selected random or continuous trapping.

Another control section included in the illustrated virtual control panel 120 is an ELIT timing section 124 which illustratively includes GUI elements for setting timing parameters relating to the operation of the ELIT 14 for the selected trapping mode. In the example illustrated in FIG. 6A, continuous trapping mode has been selected in the trapping mode section 122 as described above, and the highlighted tab at the top of the ELIT timing section 124 thus indicates that the ELIT timing parameter GUI elements relate to the continuous trapping mode. A different tab will be highlighted when trigger trapping mode is selected as also illustrated in FIG. 6A. For the continuous trapping mode selected in section 122 as shown, the ELIT timing section 124 illustratively includes GUI elements for selecting the timing between trapping events ("Between trap time"), here illustratively set at 1.0 ms. GUI elements are also provided for selecting the pre-trap and post-trap file write times as described above with respect to step 86 of the process 80 illustrated in FIG. 5, here illustratively set at 0.1 ms and 0.8 ms respectively. A GUI element is also provided for selecting delay time between controlling the voltage source V1 to control the ion mirror M1 to ion reflection mode after controlling the voltage source V2 to control the ion mirror M2 to ion reflection mode ("Front Cap delay time"), as described above with respect to FIGS. 4B and 4C for continuous trapping mode. Here, the delay time is set at 0.5 ms. Finally, a selectable GUI element is provided for selecting the trapping time, i.e., the time in which a trapped ion is allowed to oscillate back and forth between the ion mirrors M1, M2 and through the charge detection cylinder CD of the ELIT 14, also referred to herein as the ion measurement event time. In this example, the trapping time is set at 99 ms.

Another control section included in the illustrated virtual control panel 120 is an analysis section 126 which illustratively includes GUI elements for selecting an analyst from a list of analysts, for starting a regular or LC analysis and for stopping an analysis in progress.

Yet another control section included in the illustrated virtual control panel 120 is folder naming section 128 which illustratively includes a GUI field for entering a name of a folder in which the results of the analysis will be stored by the processor 52 in the memory 54.

Still another control section included in the illustrated virtual control panel 120 is a data acquisition section 130 which illustratively includes selectable GUI elements for starting and stopping the real-time analysis process described above. In the illustrated embodiment, the data acquisition section 130 further illustratively includes a selectable "ion count" GUI element for selectively viewing an ion count GUI.

Referring now to FIG. 6B, an example collection is shown of output data resulting from the real-time analysis process described above. In the illustrated example, each line (row) represents a single trapping event file with the first item 134 in the line or row identifying the file name. Empty trapping event files 136 are identified by a zero, and multiple trapping event files 138 are designated "MULTIPLE ION EVENT." Each single ion trapping event will include a mass-to-charge ratio (m/z) value 140, a charge (z) value 142, an ion mass (m) value 144 and a total trapping time (time) 146. In the illustrated example, a trapping time of 0.968 . . . indicates that the ion was trapped for the full trapping time set in the control panel 120 illustrated in FIG. 6A. The total trapping time in this example is 100 ms (including the 99 ms "trapping time" and the 1.0 ms "Between trap time" parameters selected in the control panel 120), but a small section of the time domain signal is discarded to allow the charge preamplifier CP to recover from the ion mirror potentials between switched between ion transmission and ion reflection modes.

Referring now to FIG. 6C, an example display GUI is shown including a real-time snapshot of an analysis results GUI including a histogram being constructed from output data resulting from the real-time analysis of ion measurement event data as it is produced by the ELIT 14. Illustratively, the GUI includes a plurality of sections each including selectable GUI elements for controlling presentation of the display GUI. For example, a display selection section 137 illustratively includes GUI elements for selecting display of a mass-to-charge histogram and a mass histogram, and for selecting analysis parameters for low-charge or standard charge ions. In FIG. 6C, the low charge analysis parameters have been selected, and a resulting ion mass spectrum 135 is displayed in the display GUI which represents the data accumulated up to the point the snapshot was taken. An ion charge display control section 139 illustratively includes GUI elements for selecting ion charge bin size as well as upper and lower charge limits of ions to be displayed in the histogram. A similar ion mass display control section 141 likewise includes GUI elements for selecting ion mass bin size as well as upper and lower mass limits of ions to be displayed in the histogram when the mass histogram is selected in the display section 137 as depicted in the example illustrated in FIG. 6C. In cases where the mass-to-charge histogram is selected in the display section 137, the control section 141 will similarly includes GUI elements for selecting ion mass-to-charge ratio bin size as well as upper and lower mass-to-charge ratio limits of ions to be displayed in the histogram. A trapping efficiency monitor section 143 illustratively tracks and displays a running tally of single ion, multiple ion and empty trapping events, and further illustratively displays a resulting trapping efficiency. As noted above, the maximum attainable single ion trap trapping efficiency for ions which arrive at random times is 37%, and the trapping efficiency of 35.7% displayed in the section 143 of FIG. 6C is therefore close to maximum trapping efficiency.

The combination of the real-time analysis process and real-time visualization of the analysis results via the real-time control GUI illustratively provides opportunities to modify operation of the CDMS system 10 in real time to selectively optimize one or more operating parameters of the CDMS system 10 generally and/or of the ELIT 14 specifically, and/or to selectively confine the analysis results to one or more selectable ranges. Referring to FIGS. 7A and 7B, for example, another embodiment of a CDMS system 150 is shown. The CDMS system 150 is identical in many respects to the CDMS system 10 described in detail above, and in this regard like numbers are used to identify like components. In particular, the ion source 12 is illustratively as described above, as is the ELIT 14. Although not specifically shown in FIGS. 7A and 7B, it will be understood the CDMS system 150 also includes the electrical components and voltage sources coupled thereto as illustrated in FIGS. 1-3 and operable as described above. The CDMS 150 illustratively differs from the CDMS system 10 by the inclusion in the CDMS system 150 of an embodiment of an apparatus 152 interposed between the ion source 12 and the ELIT 14 which may be controlled, e.g., selectively by a user of the real-time control GUI or automatically by the processor 52, to modify the signal intensity of ions exiting the ion source 12 and entering the ELIT 14 in a manner which maximizes the number of single ion trapping events relative to empty trapping events and/or multiple ion trapping events, thereby reducing ion measurement event collection time.

In the illustrated embodiment, the ion signal intensity control apparatus 152 takes the form of a variable aperture control apparatus including an electrically-controlled motor 154 operatively coupled to variable aperture-member 156 via a drive shaft 158. In the illustrated embodiment, the variable-aperture member 156 is illustratively provided in the form of a rotatable disk defining therethrough multiple apertures $\mathbf{160}_1$-$\mathbf{160}_L$ of differing diameters all centered on and along a common radius 162 positioned in alignment with the longitudinal axis 20 of the ELIT 14 so as to align with the ion entrance to the ion mirror M1 of the ELIT 14 as shown. The variable L may be any positive integer, and in the example illustrated in FIG. 7B eight such apertures $\mathbf{160}_1$-$\mathbf{160}_8$ are evenly distributed about and centered on a radius 162 spaced apart from the drive shaft 158 illustratively coupled to a center point of the disk 156, wherein the diameters of the apertures $\mathbf{160}_1$-$\mathbf{160}_8$ illustratively increase incrementally in diameter between a smallest diameter aperture $\mathbf{160}_1$ and a largest diameter aperture $\mathbf{160}_8$.

The motor 154 is illustratively a precision rotary positioning motor configured to be responsive to a motor control signal, MC, to rotate the disk 156 from a position in which one of the apertures $\mathbf{160}_1$-$\mathbf{160}_8$ is aligned with the axis 120 to a position in which the next aperture, or a selected one of the apertures $\mathbf{160}_1$-$\mathbf{160}_8$, is aligned with the axis 120. In some embodiments the motor 154 is operable to rotate the disk 156 only in a single direction, i.e., either clockwise or counterclockwise, and in other embodiments the motor 154 is operable to rotate the disk 156 in either direction. In some embodiments the motor 154 may be a continuous drive motor, and in other embodiments the motor 154 may be a step-drive or stepper motor. In some embodiments the motor 154 may be a single-speed motor, and in other embodiments the motor 154 may be a variable-speed motor.

In operation, the motor 154 is illustratively controlled to selectively position desired ones of the apertures $\mathbf{160}_1$-$\mathbf{160}_8$ in-line with the trajectory of ions entering the ELIT 14. Smaller diameter apertures decrease the signal intensity of ions entering the ELIT 14 relative to the larger diameter apertures by restricting the flow of ions therethrough, and larger diameter apertures increase the signal intensity of ions entering the ELIT 14 relative to the smaller diameter apertures by increasing the flow of ions therethrough. Depending upon the sample composition, dimensions of the CDMS and ELIT components and other factors, at least one of the apertures $\mathbf{160}_1$-$\mathbf{160}_8$ will result in a greater number of single ion trapping events as compared with the number of empty trapping events and/or with the number of multiple ion trapping events. Increasing the aperture diameter, for example, will increase the signal intensity of incoming ions and will therefore reduce the number of empty trapping events. Decreasing the aperture diameter, on the other hand, will decrease the signal intensity of incoming ions and will therefore reduce the number of multiple ion trapping events. One of the apertures $\mathbf{160_1}$-$\mathbf{160_8}$ will therefore optimize the signal intensity of incoming ions by minimizing both empty and multiple ion trapping events, thereby maximizing the number of single ion trapping events relative to empty ion trapping events and also relative to multiple ion trapping events.

In some embodiments, selection of a desired one of the apertures $\mathbf{160_1}$-$\mathbf{160_8}$ may be a manual process conducted by a user of the CDMS 150. In such embodiments, the real-time control GUI will illustratively include an aperture control section including one or more selectable GUI elements for controlling the motor control signal MC in a manner which causes the motor 154 to drive the disk 156 to a corresponding or desired one of the apertures $\mathbf{160_1}$-$\mathbf{160_8}$. By viewing the trapping efficiency monitor section 143 of the display GUI illustrated in FIG. 6C, the user may selectively control the variable aperture control apparatus 152 to maximize the single ion trapping efficiency. In alternate embodiments, or as a selectable option via the real-time control GUI, the memory 54 may include instructions which, when executed by the processor 52, cause the processor 52 to monitor the trapping efficiency and automatically control the variable aperture control apparatus 152 to maximize single ion trapping events.

Those skilled in the art will recognize other structures and/or techniques for controlling the intensity or flow of ions entering the ELIT 14 in order to maximize single ion trapping events relative to empty trapping events and/or relative to multiple ion trapping events, and it will be understood that any such other structures and/or techniques are intended to fall within the scope of this disclosure. As one non-limiting example of an alternative ion intensity or flow control apparatus, the motor 154 and the disk 156 illustrated in FIGS. 7A and 7B may be replaced by an apparatus having a single variable-diameter aperture, in which the diameter of the single aperture may be controlled, manually or automatically, to a desired aperture as described above. As another non-limiting example, the motor 154 and disk 156 may be replaced with a linear-drive motor and a plate or other structure having apertures arranged and centered along a common linear path, wherein the linear drive motor may be controlled similarly as described above to select one of the apertures along the linear path of apertures to align with the axis 20 such that ions entering the ELIT must pass through the selected aperture. As yet another non-limiting example of an alternative ion intensity or flow control apparatus, a conventional ion trap may be placed between the ion source 12 and the ELIT 14. Such an ion trap may be controlled in a conventional manner to accumulate ions over time, and the timing of the opening of this ion trap and opening/closing of the ELIT 14 may be adjusted in real time to maximize the number of single ion trapping events while avoiding discrimination against specific mass-to-charge values, e.g., such as by controlling the timing between the ion trap and the ELIT to average out the mass-to-charge filtering effect over time. Alternatively, this timing may be adjusted to preferentially trap ions with specific mass-to-charge values or ranges while also maximizing single ion trapping events. Such and ion trap may illustratively be implemented in the form of a conventional RF trap (e.g., quadrupole, hexapole or segmented quadrupole), or another ELIT.

Figure 8:
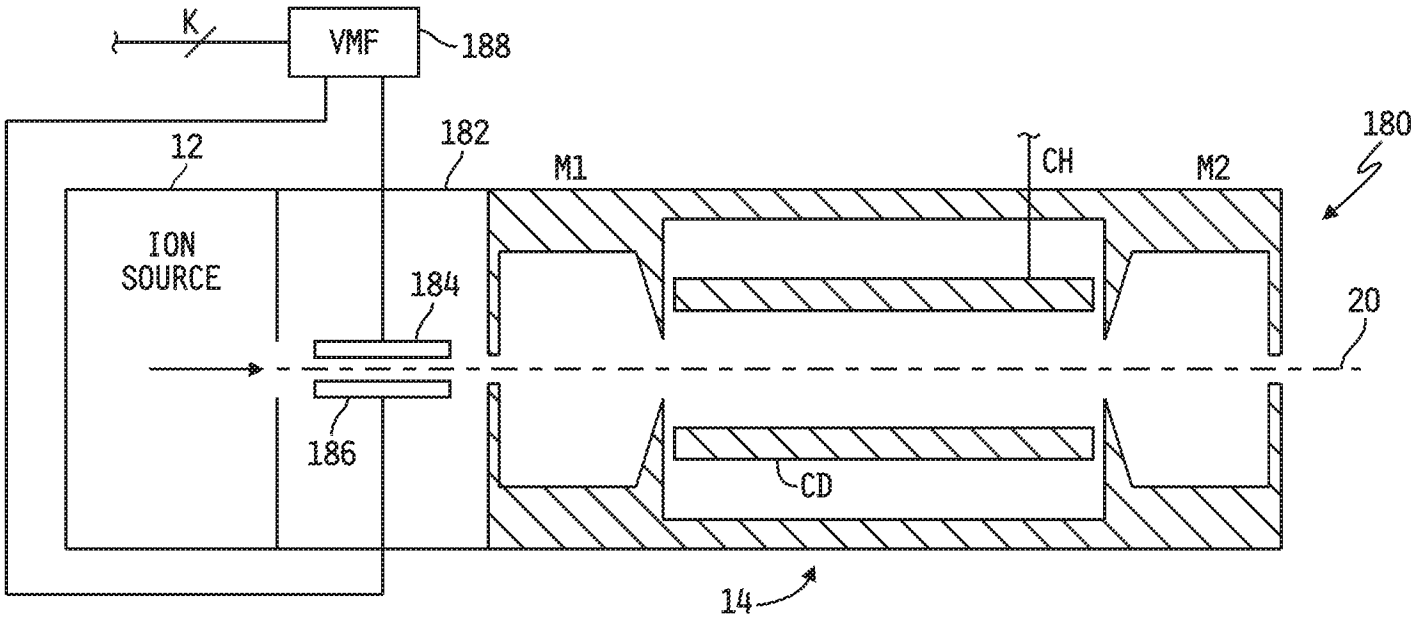
FIG. 8 is a simplified diagram of a CDMS system similar to that illustrated in FIGS. 1 and 3, and including an embodiment of a mass filter interposed between the ion source and the ELIT.

Referring to FIG. 8, another example embodiment of a CDMS system 180 is shown with which the combination of the real-time analysis process and real-time visualization of the analysis results via the real-time control GUI illustratively provides for selective confinement the analysis results to one or more desired ranges. The CDMS system 180 is identical in many respects to the CDMS system 10 described in detail above, and in this regard like numbers are used to identify like components. In particular, the ion source 12 is illustratively as described above, as is the ELIT 14. Although not specifically shown in FIG. 8, it will be understood the CDMS system 180 also includes the electrical components and voltage sources coupled thereto as illustrated in FIGS. 1-3 and operable as described above. The CDMS 180 illustratively differs from the CDMS system 10 by the inclusion in the CDMS system 180 of an embodiment of a mass-to-charge filter 182 interposed between the ion source 12 and the ELIT 14 which may be controlled, e.g., selectively by a user of the real-time control GUI or automatically by the processor 52, to restrict the ions entering the ELIT 14 to a selected mass-to-charge ratio or range of ion mass-to-charge ratios such that the resulting mass spectrum is similarly restricted to the selected range of ion mass-to-charge ratio or range of mass-to-charge ratios.

In the illustrated embodiment, the mass-to-charge filter 182 takes the form of a conventional quadrupole device including four elongated rods spaced apart from one another about the longitudinal axis 20 of the CDMS 180. Two opposed ones of the elongated rods are represented as 184 in FIG. 8, and the other two opposed ones of the elongated rods are represented as 186. A mass-to-charge filter voltage source 188 ($V_{MF}$) is electrically connected to the quadrupole rods in a conventional manner such that two opposed rods 184 are 180 degrees out of phase with the other two opposed rods 186 as shown. The mass-to-charge filter voltage source 188 may illustratively include one or more time-varying voltage sources, e.g., conventional RF voltage source(s) and may, in some embodiments, include one or more DC voltage sources. Any number, K, of signal lines may be coupled between the processor 52 and the mass filter voltage source 188 for control of the voltage source 188 by the processor 52 to produce one or more time-varying voltages of a selected frequency and/or to produce one or more DC voltages, wherein K may be any integer.

In operation, the voltage(s) produced by the mass-to-charge filter voltage source 188 is/are controlled to selectively cause ions only of a selected mass-to-charge ratio or range of mass-to-charge ratios to pass through the mass-to-charge filter 182 and into the ELIT 14. Accordingly, only such ions will be included in the ion measurement events and thus in the mass or mass-to-charge ratio spectrum resulting from the analysis thereof. In some embodiments, selection of the one or more voltages produced by the mass-to-charge filter voltage source 188 may by a manual process conducted by a user of the CDMS 180. In such embodiments, the real-time control GUI will illustratively include a mass-to-charge filter control section including one or more selectable GUI elements for controlling the voltage(s) produced by the voltage source 188 to select a corresponding mass-to-charge ratio or range of mass-to-charge ratios of ions to be selected and passed through the filter 182 into the ELIT 14. Such selection may be carried out at the outset of the sample analysis or may be carried out after viewing the mass spectrum constructed in real-time in the display GUI illustrated in FIG. 6C. An example of the latter is illustrated in FIGS. 9A and 9B.

Figure 9A:
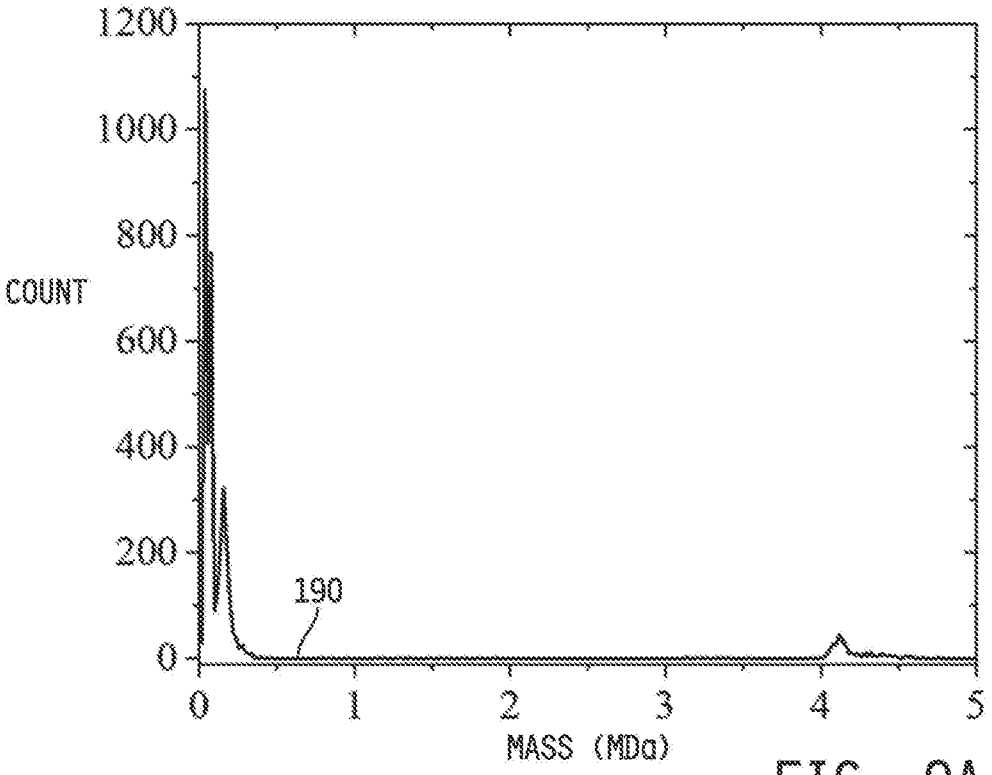
FIG. 9A is a plot of a complete mass spectrum produced by the CDMS of FIG. 1 of an example biological sample.
Figure 9B:
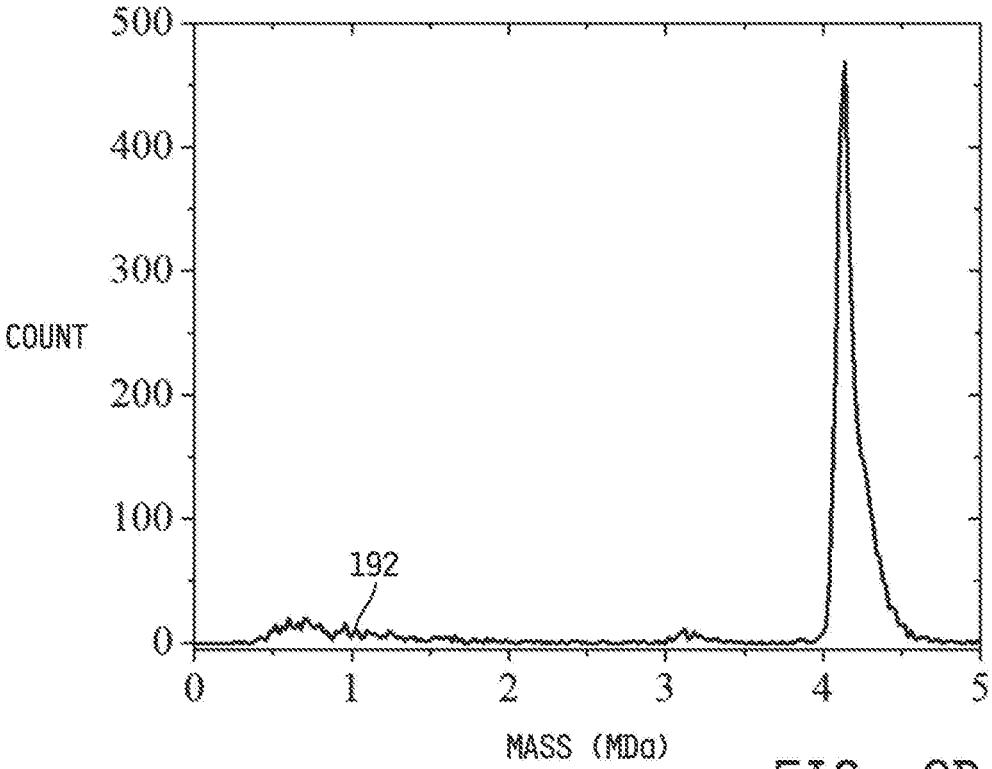
FIG. 9B is a plot of a mass spectrum produced by the CDMS of FIG. 8 for the same sample used to produce the complete mass spectrum of FIG. 9A, in which ions having masses within a specified range of the complete mass spectrum have been removed by the mass filter prior to analysis by the ELIT.

Referring to FIG. 9A, a mass distribution plot 190 of ion count vs. ion mass (in units of mega-Daltons or MDa) is shown for a sample of the hepatitis B virus (HBV) capsid as it is being assembled in real time. It is to be understood that the plot 190 is part of the analysis results GUI illustrated in FIG. 6C, and thus represents the real-time mass spectrum of the HBV sample as it is being constructed by the processor 152 according to the real-time analysis process described above. At the point of time in the assembly of the mass distribution 190 illustrated in FIG. 9A, the spectrum illustratively contains 5,737 ions from 15,999 trapping events recorded over 26.7 minutes. As depicted in FIG. 9A, the mass distribution 190 includes a large number of low-mass species (e.g., <500 kDa) and a smaller number of higher-mass species near 4 MDa, which is close to the expected mass for the HBV Cp149 T=4 capsid of just over 4.1 MDa.

In the analysis illustrated in FIG. 9A, the user (analyst) may not be interested in the low mass species which dominate the mass spectrum 190. As such, a large fraction of the ion collection and analysis time has been wasted since, with CDMS being a single-particle technique, time spent trapping and analyzing the low mass ions cannot also be used to trap and analyze high mass ions. In order to avoid collecting and analyzing the low mass ions, the voltage source(s) 188 may illustratively be controlled to produce a time-varying voltage (e.g., RF) only to thereby cause the mass-to-charge filter 182 to act as a high-pass mass-to-charge filter to thereby pass therethrough only ions above a selected mass-to-charge ratio or range of mass-to-charge ratios. It is generally known that with an RF-only quadrupole, the lowest mass-to-charge ratio that will pass therethrough depends on the frequency of the time-varying voltage produced by the voltage source 188. In one example experiment, the frequency of the time-varying voltage applied by the voltage source 188 to the quadrupole mass filter 182 was set to 120 kHz, and the resulting mass distribution plot 192 of ion count vs. ion mass (in units of mega-Daltons or MDa) is shown in FIG. 9B for same sample of the hepatitis B virus (HBV) capsid (used to generate the plot illustrated in FIG. 9A) as it is being assembled in real time. With the frequency of the RF-only voltage produced by the voltage source 188 set to 120 kHz, most of the ions trapped in the ELIT 14 have masses greater than 400 kDa, thereby omitting from the spectrum 192 the large number of low-mass species (e.g., <500 kDa) present in the spectrum 190 of FIG. 9A. Most of the ion collection and analysis time to produce the spectrum 192 illustrated in FIG. 9B was accordingly spent trapping and analyzing the higher mass ions. It should be noted that the RF-only quadrupole operates as mass-to-charge filter rather than a mass filter, which is why the mass cut-off in FIG. 9B is not sharp. It should also be noted that the plot 192 of trapped ions having masses greater than 400 kDa includes a low-intensity peak with a mass of about 3.1 MDa, which was not evident in the mass distribution of FIG. 9A.

It will be understood that the voltage source 188 may illustratively be controlled to apply only a time-varying set (e.g., 180 degrees out of phase) of voltages at a specified frequency to cause the quadrupole filter 182 to act as a high-pass mass-to-charge filter passing only ions having mass-to-charge ratios above a selected mass-to-charge ratio value. Alternatively, the mass-to-charge filter voltage source 188 may illustratively be controlled to apply a combination of a time-varying set of voltages at a specified frequency and a dc voltage with a selected magnitude (e.g., with opposite polarities applied to different opposed pairs of the quadrupole rods) to cause the quadrupole filter 182 to act as a band-pass filter passing only ions having mass-to-charge ratios within a selected range of mass-to-charge ratio values, wherein the frequency of the time-varying set of voltages and the magnitude of the set of DC voltages will together define the range of passable mass-to-charge ratios. In still other embodiments in which the mass-to-charge ratio range of ions entering the ELIT 14 is not to be restricted, the quadrupole filter 182 may illustratively be operated as a DC-only quadrupole, i.e., by applying only a DC voltage to and between opposing pairs of the quadrupole rods, to focus ions entering the ELIT 14 toward the longitudinal axis 20 thereof.

Those skilled in the art will recognize other structures and/or techniques for restricting the mass-to-charge ratio range of ions entering the ELIT 14, and it will be understood that any such other structures and/or techniques are intended to fall within the scope of this disclosure. As one non-limiting example, the mass-to-charge filter 182 may alternatively take the form of a conventional hexapole or octupole ion guide. As another non-limiting example, the mass-to-charge filter 182 may alternatively take the form of one or more conventional ion traps operable in a conventional manner to trap therein ions exiting the ion source and to allow only ions within a selected range of mass-to-charge ratios to exit and thus enter the ELIT 14.

Figure 10A:
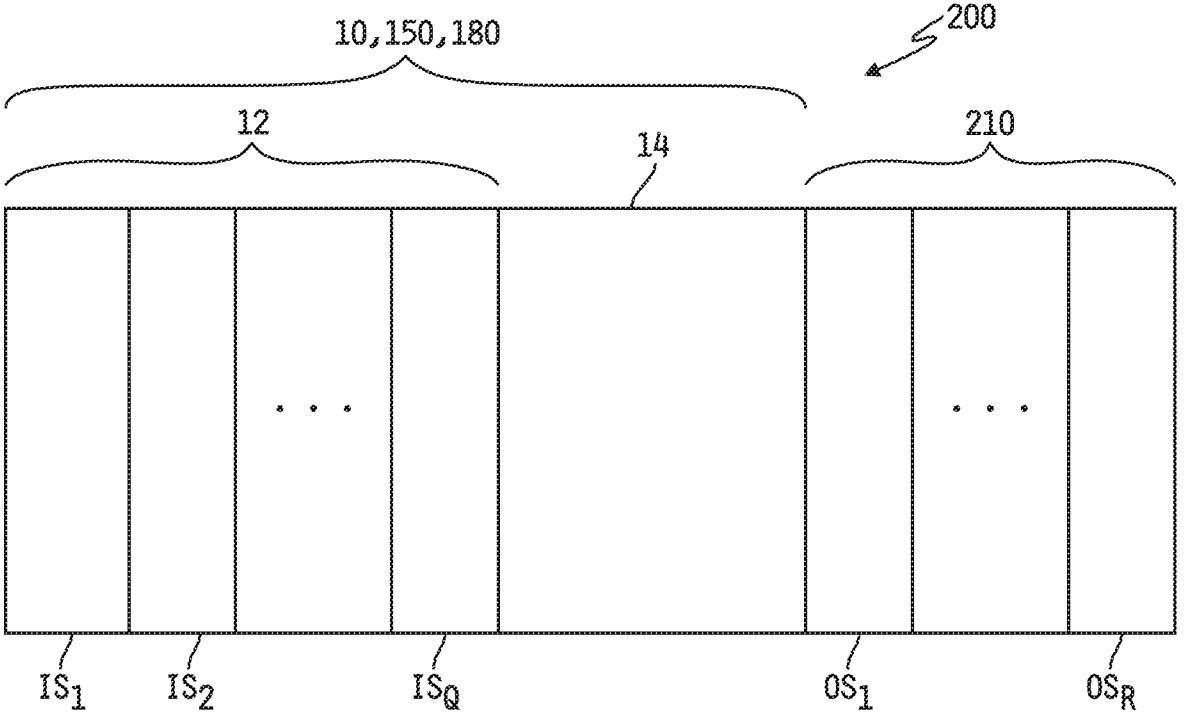
FIG. 10A is a simplified block diagram of an embodiment of an ion separation instrument including any of the CDMS instruments of FIGS. 1, 7A-7B and 8, showing example ion processing instruments which may form part of the ion source upstream of the ELIT and/or which may be disposed downstream of the ELIT to further process ion(s) exiting the ELIT.

Referring now to FIG. 10A, a simplified block diagram is shown of an embodiment of an ion separation instrument 200 which may include the ELIT 14 illustrated and described herein, and which may include the charge detection mass spectrometer (CDMS) 10, 150, 180 illustrated and described herein, and which may include any number of ion processing instruments which may form part of the ion source 12 upstream of the ELIT 14 and/or which may include any number of ion processing instruments which may be disposed downstream of the ELIT 14 to further process ion(s) exiting the ELIT 14. In this regard, the ion source 12 is illustrated in FIG. 10A as including a number, Q, of ion source stages $IS_1$-$IS_Q$ which may be or form part of the ion source 12. Alternatively or additionally, an ion processing instrument 210 is illustrated in FIG. 10A as being coupled to the ion outlet of the ELIT 14, wherein the ion processing instrument 210 may include any number of ion processing stages $OS_1$-$OS_R$, where R may be any positive integer.

Focusing on the ion source 12, it will be understood that the source 12 of ions entering the ELIT 14 may be or include, in the form of one or more of the ion source stages $IS_1$-$IS_Q$, one or more conventional sources of ions as described above, and may further include one or more conventional instruments for separating ions according to one or more molecular characteristics (e.g., according to ion mass, ion mass-to-charge, ion mobility, ion retention time, or the like) and/or one or more conventional ion processing instruments for collecting and/or storing ions (e.g., one or more quadrupole, hexapole and/or other ion traps), for filtering ions (e.g., according to one or more molecular characteristics such as ion mass, ion mass-to-charge, ion mobility, ion retention time and the like), for fragmenting or otherwise dissociating ions, for normalizing or shifting ion charge states, and the like. It will be understood that the ion source 12 may include one or any combination, in any order, of any such conventional ion sources, ion separation instruments and/or ion processing instruments, and that some embodiments may include multiple adjacent or spaced-apart ones of any such conventional ion sources, ion separation instruments and/or ion processing instruments, some non-limiting examples of which are illustrated in FIGS. 7A, 7B and in FIG. 8. In any implementation which includes one or more mass spectrometers, any one or more such mass spectrometers may be implemented in any of the forms described herein.

Turning now to the ion processing instrument 210, it will be understood that the instrument 210 may be or include, in the form of one or more of the ion processing stages $OS_1$-$OS_R$, one or more conventional instruments for separating ions according to one or more molecular characteristics (e.g., according to ion mass, ion mass-to-charge, ion mobility, ion retention time, or the like) and/or one or more conventional ion processing instruments for collecting and/or storing ions (e.g., one or more quadrupole, hexapole and/or other ion traps), for filtering ions (e.g., according to one or more molecular characteristics such as ion mass, ion mass-to-charge, ion mobility, ion retention time and the like), for fragmenting or otherwise dissociating ions, for normalizing or shifting ion charge states, and the like. It will be understood that the ion processing instrument 110 may include one or any combination, in any order, of any such conventional ion separation instruments and/or ion processing instruments, and that some embodiments may include multiple adjacent or spaced-apart ones of any such conventional ion separation instruments and/or ion processing instruments. In any implementation which includes one or more mass spectrometers, any one or more such mass spectrometers may be implemented in any of the forms described herein.

As one specific implementation of the ion separation instrument 200 illustrated in FIG. 10A, which should not be considered to be limiting in any way, the ion source 12 illustratively includes 3 stages, and the ion processing instrument 210 is omitted. In this example implementation, the ion source stage $IS_1$ is a conventional source of ions, e.g., electrospray, MALDI or the like, the ion source stage $IS_2$ is a conventional ion filter, e.g., a quadrupole or hexapole ion guide, and the ion source stage $IS_3$ is a mass spectrometer of any of the types described above. In this embodiment, the ion source stage $IS_2$ is controlled in a conventional manner to preselect ions having desired molecular characteristics for analysis by the downstream mass spectrometer, and to pass only such preselected ions to the mass spectrometer, wherein the ions analyzed by the ELIT 14 will be the preselected ions separated by the mass spectrometer according to mass-to-charge ratio. The preselected ions exiting the ion filter may, for example, be ions having a specified ion mass or mass-to-charge ratio, ions having ion masses or ion mass-to-charge ratios above and/or below a specified ion mass or ion mass-to-charge ratio, ions having ion masses or ion mass-to-charge ratios within a specified range of ion mass or ion mass-to-charge ratio, or the like. This example illustrates one possible variant of the embodiment of the CDMS system 180 illustrated in FIG. 8. In some alternate implementations of this example, the ion source stage $IS_2$ may be the mass spectrometer and the ion source stage $IS_3$ may be the ion filter, and the ion filter may be otherwise operable as just described to preselect ions exiting the mass spectrometer which have desired molecular characteristics for analysis by the downstream ELIT 14. This is the configuration illustrated by example in FIG. 8. In other alternate implementations of this example, the ion source stage $IS_2$ may be the ion filter, and the ion source stage $IS_3$ may include a mass spectrometer followed by another ion filter, wherein the ion filters each operate as just described, and thus serves as yet another variant of the example illustrated in FIG. 8.

As another specific implementation of the ion separation instrument 200 illustrated in FIG. 10A, which should not be considered to be limiting in any way, the ion source 12 illustratively includes 2 stages, and the ion processing instrument 210 is again omitted. In this example implementation, the ion source stage $IS_1$ is a conventional source of ions, e.g., electrospray, MALDI or the like, the ion source stage $IS_2$ is a conventional mass spectrometer of any of the types described above. This is the implementation described above with respect to FIG. 1 in which the ELIT 14 is operable to analyze ions exiting the mass spectrometer.

As yet another specific implementation of the ion separation instrument 200 illustrated in FIG. 10A, which should not be considered to be limiting in any way, the ion source 12 illustratively includes 2 stages, and the ion processing instrument 210 is omitted. In this example implementation, the ion source stage $IS_1$ is a conventional source of ions, e.g., electrospray, MALDI or the like, and the ion processing stage $OS_2$ is a conventional single or multiple-stage ion mobility spectrometer. In this implementation, the ion mobility spectrometer is operable to separate ions, generated by the ion source stage $IS_1$, over time according to one or more functions of ion mobility, and the ELIT 14 is operable to analyze ions exiting the ion mobility spectrometer. In an alternate implementation of this example, the ion source 12 may include only a single stage $IS_1$ in the form of a conventional source of ions, and the ion processing instrument 210 may include a conventional single or multiple-stage ion mobility spectrometer as a sole stage $OS_1$ (or as stage $OS_1$ of a multiple-stage instrument 210). In this alternate implementation, the ELIT 14 is operable to analyze ions generated by the ion source stage $IS_1$, and the ion mobility spectrometer $OS_1$ is operable to separate ions exiting the ELIT 14 over time according to one or more functions of ion mobility. As another alternate implementation of this example, single or multiple-stage ion mobility spectrometers may follow both the ion source stage $IS_1$ and the ELIT 14. In this alternate implementation, the ion mobility spectrometer following the ion source stage $IS_1$ is operable to separate ions, generated by the ion source stage $IS_1$, over time according to one or more functions of ion mobility, the ELIT 14 is operable to analyze ions exiting the ion source stage ion mobility spectrometer, and the ion mobility spectrometer of the ion processing stage $OS_1$ following the ELIT 14 is operable to separate ions exiting the ELIT 14 over time according to one or more functions of ion mobility. In any implementations of the embodiment described in this paragraph, additional variants may include a mass spectrometer operatively positioned upstream and/or downstream of the single or multiple-stage ion mobility spectrometer in the ion source 12 and/or in the ion processing instrument 210.

As still another specific implementation of the ion separation instrument 200 illustrated in FIG. 10A, which should not be considered to be limiting in any way, the ion source 12 illustratively includes 2 stages, and the ion processing instrument 210 is omitted. In this example implementation, the ion source stage $IS_1$ is a conventional liquid chromatograph, e.g., HPLC or the like configured to separate molecules in solution according to molecule retention time, and the ion source stage $IS_2$ is a conventional source of ions, e.g., electrospray or the like. In this implementation, the liquid chromatograph is operable to separate molecular components in solution, the ion source stage $IS_2$ is operable to generate ions from the solution flow exiting the liquid chromatograph, and the ELIT 14 is operable to analyze ions generated by the ion source stage $IS_2$. In an alternate implementation of this example, the ion source stage $IS_1$ may instead be a conventional size-exclusion chromatograph (SEC) operable to separate molecules in solution by size. In another alternate implementation, the ion source stage $IS_1$ may include a conventional liquid chromatograph followed by a conventional SEC or vice versa. In this implementation, ions are generated by the ion source stage $IS_2$ from a twice separated solution; once according to molecule retention time followed by a second according to molecule size, or vice versa. In any implementations of the embodiment described in this paragraph, additional variants may include a mass spectrometer operatively positioned between the ion source stage $IS_2$ and the ELIT 14.

Figure 10B:
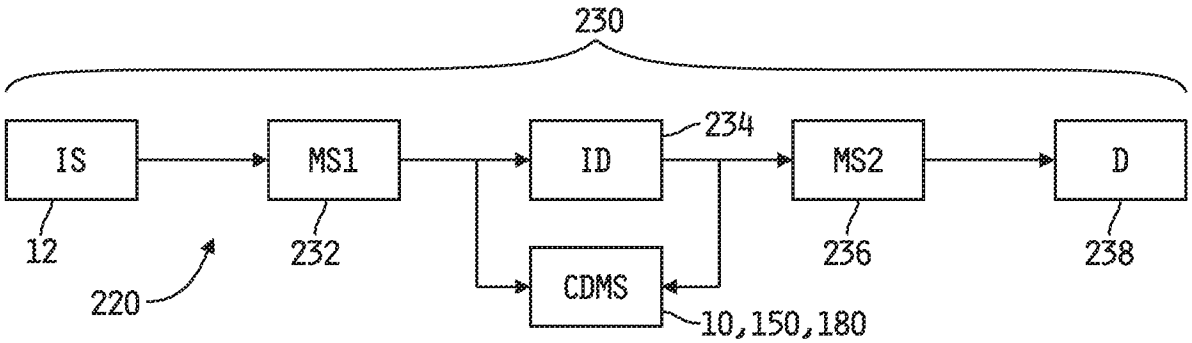
FIG. 10B is a simplified block diagram of another embodiment of an ion separation instrument including any of the CDMS instruments of FIGS. 1, 7A-7B and 8, showing an example implementation which combines conventional ion processing instruments with any of the embodiments of the CDMS systems illustrated and described herein.

Referring now to FIG. 10B, a simplified block diagram is shown of another embodiment of an ion separation instrument 220 which illustratively includes a multi-stage mass spectrometer instrument 230 and which also includes the ion mass detection system 10, 150, 180, i.e., CDMS, illustrated and described herein implemented as a high-mass ion analysis component. In the illustrated embodiment, the multi-stage mass spectrometer instrument 230 includes an ion source (IS) 12, as illustrated and described herein, followed by and coupled to a first conventional mass spectrometer (MS1) 232, followed by and coupled to a conventional ion dissociation stage (ID) 234 operable to dissociate ions exiting the mass spectrometer 232, e.g., by one or more of collision-induced dissociation (CID), surface-induced dissociation (SID), electron capture dissociation (ECD) and/or photo-induced dissociation (PID) or the like, followed by and coupled to a second conventional mass spectrometer (MS2) 236, followed by a conventional ion detector (D) 238, e.g., such as a microchannel plate detector or other conventional ion detector. The ion mass detection system 10, 150, 180, i.e., CDMS, is coupled in parallel with and to the ion dissociation stage 234 such that the ion mass detection system 10, 150, 180, i.e., CDMS, may selectively receive ions from the mass spectrometer 236 and/or from the ion dissociation stage 232.

MS/MS, e.g., using only the ion separation instrument 230, is a well-established approach where precursor ions of a particular molecular weight are selected by the first mass spectrometer 232 (MS1) based on their m/z value. The mass selected precursor ions are fragmented, e.g., by collision-induced dissociation, surface-induced dissociation, electron capture dissociation or photo-induced dissociation, in the ion dissociation stage 234. The fragment ions are then analyzed by the second mass spectrometer 236 (MS2). Only the m/z values of the precursor and fragment ions are measured in both MS1 and MS2. For high mass ions, the charge states are not resolved and so it is not possible to select precursor ions with a specific molecular weight based on the m/z value alone. However, by coupling the instrument 230 to the CDMS 10 illustrated and described herein, it is possible to select a narrow range of m/z values and then use the CDMS 10, 150, 180 to determine the masses of the m/z selected precursor ions. The mass spectrometers 232, 236 may be, for example, one or any combination of a magnetic sector mass spectrometer, time-of-flight mass spectrometer or quadrupole mass spectrometer, although in alternate embodiments other mass spectrometer types may be used. In any case, the m/z selected precursor ions with known masses exiting MS1 can be fragmented in the ion dissociation stage 234, and the resulting fragment ions can then be analyzed by MS2 (where only the m/z ratio is measured) and/or by the CDMS instrument 10, 150, 180 (where the m/z ratio and charge are measured simultaneously). Low mass fragments, i.e., dissociated ions of precursor ions having mass values below a threshold mass value, e.g., 10,000 Da (or other mass value), can thus be analyzed by conventional MS, using MS2, while high mass fragments (where the charge states are not resolved), i.e., dissociated ions of precursor ions having mass values at or above the threshold mass value, can be analyzed by CDMS.

It will be understood that the dimensions of the various components of the ELIT 14 and the magnitudes of the electric fields established therein, as implemented in any of the systems 10, 150, 180, 200, 220 illustrated in the attached figures and described above, may illustratively be selected so as to establish a desired duty cycle of ion oscillation within the ELIT 14, corresponding to a ratio of time spent by an ion in the charge detection cylinder CD and a total time spent by the ion traversing the combination of the ion mirrors M1, M2 and the charge detection cylinder CD during one complete oscillation cycle. For example, a duty cycle of approximately 50% may be desirable for the purpose of reducing noise in fundamental frequency magnitude determinations resulting from harmonic frequency components of the measured signals. Details relating to such dimensional and operational considerations for achieving a desired duty cycle, e.g., such as 50%, are illustrated and described in U.S. Patent Application Ser. No. 62/616,860, filed Jan. 12, 2018, U.S. Patent Application Ser. No. 62/680,343, filed Jun. 4, 2018 and co-pending International Patent Application No. PCT/US2019/013251, filed Jan. 11, 2019, all entitled ELECTROSTATIC LINEAR ION TRAP DESIGN FOR CHARGE DETECTION MASS SPECTROMETRY, the disclosures of which are all expressly incorporated herein by reference in their entireties.

It will be further understood that one or more charge detection optimization techniques may be used with the ELIT 14 in any of the systems 10, 150, 180, 200, 220 illustrated in the attached figures and described herein e.g., for trigger trapping or other charge detection events. Examples of some such charge detection optimization techniques are illustrated and described in U.S. Patent Application Ser. No. 62/680,296, filed Jun. 4, 2018 and in co-pending International Patent Application No. PCT/US2019/03280, filed Jan. 11, 2019, both entitled APPARATUS AND METHOD FOR CAPTURING IONS IN AN ELECTROSTATIC LINEAR ION TRAP, the disclosures of which are both expressly incorporated herein by reference in their entireties.

It will be further understood that one or more charge calibration or resetting apparatuses may be used with the charge detection cylinder CD of the ELIT 14 in any of the systems 10, 150, 180, 200, 220 illustrated in the attached figures and described herein. An example of one such charge calibration or resetting apparatus is illustrated and described in U.S. Patent Application Ser. No. 62/680,272, filed Jun. 4, 2018 and in co-pending International Patent Application No. PCT/US2019/013284, filed Jan. 11, 2019, both entitled APPARATUS AND METHOD FOR CALIBRATING OR RESETTING A CHARGE DETECTOR, the disclosures of which are both expressly incorporated herein by reference in their entireties.

It will be still further understood that the ELIT 14 illustrated in the attached figures and described herein, as part of any of the systems 10, 150, 180, 200, 220 also illustrated in the attached figures and described herein, may alternatively be provided in the form of at least one ELIT array having two or more ELITs or ELIT regions and/or in any single ELIT including two or more ELIT regions, and that the concepts described herein are directly applicable to systems including one or more such ELITs and/or ELIT arrays. Examples of some such ELITs and/or ELIT arrays are illustrated and described in U.S. Patent Application Ser. No. 62/680,315, filed Jun. 4, 2018 and in co-pending International Patent Application No. PCT/US2019/013283, filed Jan. 11, 2019, both entitled ION TRAP ARRAY FOR HIGH THROUGHPUT CHARGE DETECTION MASS SPECTROMETRY, the disclosures of which are both expressly incorporated herein by reference in their entireties.

It will be further understood that one or more ion source optimization apparatuses and/or techniques may be used with one or more embodiments of the ion source 12 illustrated and described herein as part of or in combination with any of the systems 10, 150, 180, 200, 220 illustrated in the attached figures and described herein, some examples of which are illustrated and described in U.S. Patent Application Ser. No. 62/680,223, filed Jun. 4, 2018 and in U.S. Patent Application Ser. No. 62/680,223, filed Jun. 4, 2018 and entitled HYBRID ION FUNNEL-ION CARPET (FUNPET) ATMOSPHERIC PRESSURE INTERFACE FOR CHARGE DETECTION MASS SPECTROMETRY, and in co-pending International Patent Application No. PCT/US2019/013274, filed Jan. 11, 2019 and entitled INTERFACE FOR TRANSPORTING IONS FROM AN ATMOSPHERIC PRESSURE ENVIRONMENT TO A LOW PRESSURE ENVIRONMENT, the disclosures of which are both expressly incorporated herein by reference in their entireties.

It will be still further understood that in any of the systems 10, 150, 180, 200, 220 illustrated in the attached figures and described herein, the ELIT 14 may be replaced with an orbitrap. In such embodiments, the charge preamplifier illustrated in the attached figures and described above may be replaced with one or more amplifiers of conventional design. An example of one such orbitrap is illustrated and described in U.S. Patent Application Ser. No. 62/769,952, filed Nov. 20, 2018 and in co-pending International Patent Application No. PCT/US2019/013278, filed Jan. 11, 2019, both entitled ORBITRAP FOR SINGLE PARTICLE MASS SPECTROMETRY, the disclosures of which are both expressly incorporated herein by reference in their entireties.

It will be yet further understood that one or more ion inlet trajectory control apparatuses and/or techniques may be used with the ELIT 14 of any of the systems 10, 150, 180, 200, 220 illustrated in the attached figures and described herein to provide for simultaneous measurements of multiple individual ions within the ELIT 14. Examples of some such ion inlet trajectory control apparatuses and/or techniques are illustrated and described in U.S. Patent Application Ser. No. 62/774,703, filed Dec. 3, 2018 and in co-pending International Patent Application No. PCT/US2019/013285, filed Jan. 11, 2019, both entitled APPARATUS AND METHOD FOR SIMULTANEOUSLY ANALYZING MULTIPLE IONS WITH AN ELECTROSTATIC LINEAR ION TRAP, the disclosures of which are both expressly incorporated herein by reference in their entireties.

While this disclosure has been illustrated and described in detail in the foregoing drawings and description, the same is to be considered as illustrative and not restrictive in character, it being understood that only illustrative embodiments thereof have been shown and described and that all changes and modifications that come within the spirit of this disclosure are desired to be protected. For example, it will be understood that the ELIT 14 illustrated in the attached figures and described herein is provided only by way of example, and that the concepts, structures and techniques described above may be implemented directly in ELITs of various alternate designs. Any such alternate ELIT design may, for example, include any one or combination of two or more ELIT regions, more, fewer and/or differently-shaped ion mirror electrodes, more or fewer voltage sources, more or fewer DC or time-varying signals produced by one or more of the voltage sources, one or more ion mirrors defining additional electric field regions, or the like.

What is claimed is:

1. A charge detection mass spectrometer, comprising:

an electrostatic linear ion trap (ELIT) or orbitrap, a source of ions configured to supply ions to the ELIT or orbitrap, at least one amplifier having an input operatively coupled to the ELIT or orbitrap, at least one processor operatively coupled to the ELIT or orbitrap and to an output of the at least one amplifier, and at least one memory having instructions stored therein which, when executed by the at least one processor, cause the at least one processor to (i) control the ELIT or orbitrap as part of an ion trapping event to attempt to trap therein a single ion supplied by the ion source, (ii) record ion measurement information based on output signals produced by the at least one amplifier over a duration of the ion trapping event, (iii) determine, based on the recorded ion measurement information, whether the control of the ELIT or orbitrap resulted in trapping therein of a single ion, of no ion or of multiple ions, (iv) compute at least one of an ion mass and an ion mass-to-charge ratio based on the recorded ion measurement information only if a single ion was trapped in the ELIT or orbitrap during the trapping event, (v) repeatedly execute (i)-(iv), and (vi) construct a histogram of the computed ones of the at least one of the ion mass and the ion mass-to-charge ratio for each of a plurality of different ion trapping events in real time following each determination that the control of the ELIT or orbitrap resulted in trapping therein of a single ion and subsequent computation of the one of the at least one of the ion mass and the ion mass-to-charge ratio.

2. The charge detection mass spectrometer of claim 1, further comprising a display monitor, wherein the instructions stored in the at least one memory further include instructions which, when executed by the at least one processor, cause the at least one processor to control the display monitor to display construction of the histogram in real time.

3. The charge detection mass spectrometer of claim 1, wherein the ELIT is operatively coupled to the source of ions and to the at least one processor, and the at least one amplifier comprises a charge preamplifier operatively coupled to the ELIT and to the at least one processor, and wherein the ELIT includes a first ion mirror defining a first passageway, a second ion mirror defining a second passageway and a charge detection cylinder defining a third passageway therethrough, wherein the first, second and third passageways are coaxially aligned with the charge detection cylinder positioned between the first and second ion mirrors such that a longitudinal axis passes centrally through each of the first, second and third passageways, the first ion mirror defining an ion inlet aperture via which ions supplied by the source of ions enter the ELIT, and wherein the charge detection mass spectrometer further comprises at least one voltage source operatively coupled to the at least one processor and to the first and second ion mirrors and configured to selectively establish an ion transmission electric field or an ion reflection electric field therein, the ion transmission electric field focusing an ion passing through a respective one of the first and second ion mirrors toward the longitudinal axis, the ion reflection electric field causing an ion entering a respective one of the first and second ion mirrors from the charge detection cylinder to stop and accelerate in an opposite direction back through the charge detection cylinder toward the other of the first and second ion mirrors while also focusing the ion toward the longitudinal axis, and wherein the instructions stored in the at least one memory include instructions which, when executed by the at least one processor, cause the at least one processor to control the ELIT to attempt to trap the single ion therein by controlling the at least one voltage source to selectively establish the ion transmission electric field in each of the first and second ion mirrors such that ions supplied by the source of ions pass through the ELIT, followed by controlling the at least one voltage source to selectively establish ion reflection electric fields in each of the first and second ion mirrors such that any ion or ions trapped within the ELIT oscillate back and forth through the charge detection cylinder between the first and second ion mirrors.

4. The charge detection mass spectrometer of claim 3, wherein the instructions stored in the at least one memory include instructions which, when executed by the at least one processor, cause the at least one processor to record the ion measurement information by, following the control of the at least one voltage source to establish the ion reflection electric field in each of the first and second ion mirrors, storing in the at least one memory each charge detection signal produced by the charge preamplifier signal for the duration of the trapping event.

5. The charge detection mass spectrometer of claim 1, further comprising means for controlling an intensity or flow of ions exiting the source of ions and entering the ELIT or orbitrap to an ion intensity or ion flow which minimizes multiple ion trapping events and no ion trapping events.

6. The charge detection mass spectrometer of claim 1, further comprising:

at least one ion mass-to-charge filter operatively positioned between the source of ions and the ELIT or orbitrap, at least another voltage source operatively coupled to the at least one processor and to ion mass-to-charge filter, and means for controlling the at least another voltage source to produce at least one selected voltage to which the ion mass-to-charge filter is responsive to pass therethrough to the ELIT or orbitrap only ions having a selected mass-to-charge ratio or only ions having a selected range of mass-to-charge ratio values.

7. A charge detection mass spectrometer, comprising:

an electrostatic linear ion trap (ELIT) or orbitrap, a source of ions configured to supply ions to the ELIT or orbitrap, at least one amplifier having an input operatively coupled to the ELIT or orbitrap, at least one processor operatively coupled to the ELIT or orbitrap and to an output of the at least one amplifier, and at least one memory having instructions stored therein which, when executed by the at least one processor, cause the at least one processor to (i) control the ELIT or orbitrap as part of an ion trapping event to attempt to trap therein a single ion supplied by the ion source, (ii) record ion measurement information based on output signals produced by the at least one amplifier over a duration of the ion trapping event, (iii) determine, based on the recorded ion measurement information, whether the control of the ELIT or orbitrap resulted in trapping therein of a single ion, of no ion or of multiple ions, and (iv) compute at least one of an ion mass and an ion mass-to-charge ratio based on the recorded ion measurement information only if a single ion was trapped in the ELIT or orbitrap during the trapping event, wherein the instructions stored in the at least one memory further include instructions which, when executed by the at least one processor, cause the at least one processor to record the ion measurement information by storing the ion measurement information in a file in the at least one memory, and to compute a Fourier Transform of the ion measurement information stored in the file to produce a frequency domain spectrum thereof.

8. The charge detection mass spectrometer of claim 7, wherein the instructions stored in the at least one memory include instructions which, when executed by the at least one processor, cause the at least one processor to scan the frequency domain spectrum of the recorded ion measurement information to locate and identify peaks in the frequency domain spectrum.

9. The charge detection mass spectrometer of claim 8, wherein the instructions stored in the at least one memory include instructions which, when executed by the at least one processor, cause the at least one processor to determine that the control of the ELIT or orbitrap resulted in trapping therein of no ions if no peaks were located in the scanned frequency spectrum of the recorded ion measurement information, and to then preliminarily identify the ion trapping event as an empty trapping event.

10. The charge detection mass spectrometer of claim 8, wherein the instructions stored in the at least one memory include instructions which, when executed by the at least one processor, cause the at least one processor to, if peaks were located in the scanned frequency domain spectrum of the recorded ion measurement information, identify as a fundamental frequency of the frequency domain spectrum the one of the located peaks having the largest magnitude, and to determine whether the remaining ones of the located peaks are located at harmonic frequencies relative to the fundamental frequency.

11. The charge detection mass spectrometer of claim 10, wherein the instructions stored in the at least one memory include instructions which, when executed by the at least one processor, cause the at least one processor to determine that the control of the ELIT or orbitrap resulted in trapping therein of multiple ions if the remaining ones of the located peaks are not located at harmonic frequencies relative to the fundamental frequency, and to then identify the ion trapping event as multiple ion trapping event.

12. The charge detection mass spectrometer of claim 10, wherein the instructions stored in the at least one memory include instructions which, when executed by the at least one processor, cause the at least one processor to determine that the control of the ELIT or orbitrap resulted in trapping therein of a single ion if the remaining ones of the located peaks are located at harmonic frequencies relative to the fundamental frequency, and to then identify the ion trapping event as a single ion trapping event.

13. The charge detection mass spectrometer of claim 9, wherein the instructions stored in the at least one memory include instructions which, when executed by the at least one processor, cause the at least one processor to, if the ion trapping event is preliminarily identified as an empty ion trapping event or a single ion trapping event, (a) compute a Fourier transform of a window of the recorded ion measurement information at the beginning of the file to produce a corresponding frequency domain spectrum thereof, wherein the window has a window size defined as a predefined number of recorded ion measurement information data points, (b) scan the frequency domain spectrum of the window of the recorded ion measurement information to locate and identify peaks therein, (c) if no peaks are located in the scanned frequency domain spectrum of the window of the recorded ion measurement information, increase the window size and re-execute (a) and (b), and (d) repeat (a)-(c) until a peak is located or until the window size has been increased to include all of the recorded ion measurement information stored in the file.

14. The charge detection mass spectrometer of claim 13, wherein the instructions stored in the at least one memory include instructions which, when executed by the at least one processor, cause the at least one processor to, if the ion trapping event is preliminarily identified as an empty ion trapping event, confirm that the control of the ELIT or orbitrap resulted in trapping therein of no ions and finally identify the ion trapping event as an empty trapping event if no peaks were located in the scanned frequency domain spectrum of the window of the recorded ion measurement information and the window size has been increased to include all of the recorded ion measurement information stored in the file.

15. The charge detection mass spectrometer of claim 13, wherein the instructions stored in the at least one memory include instructions which, when executed by the at least one processor, cause the at least one processor to store the window size if a peak is located in the scanned frequency domain spectrum of the window of the recorded ion measurement information.

16. The charge detection mass spectrometer of claim 15, wherein the instructions stored in the at least one memory include instructions which, when executed by the at least one processor, cause the at least one processor to re-identify the trapping event as a single ion trapping event if the trapping event was preliminarily identified as an empty trapping event.

17. The charge detection mass spectrometer of claim 15, wherein the instructions stored in the at least one memory include instructions which, when executed by the at least one processor, cause the at least one processor to (e) incrementally scan the window having the stored window size across the recorded ion measurement information stored in the file, and at each increment of the window, (i) compute a Fourier transform of the window of the recorded ion measurement information to produce a corresponding frequency domain spectrum thereof, and (ii) determine an oscillation frequency and a magnitude of the frequency domain data of the scanned frequency domain spectrum of the window of the recorded ion measurement information, and (f) compute an average ion mass-to-charge ratio, an average ion charge and an average ion mass based on the oscillation frequency and magnitude determinations.

18. A method of operating a charge detection mass spectrometer including an electrostatic linear ion trap (ELIT) or an orbitrap, a source of ions configured to supply ions to the ELIT or orbitrap, and at least one amplifier having an input operatively coupled to the ELIT or orbitrap, the method comprising:

(i) with a processor, controlling the ELIT or orbitrap as part of an ion trapping event to attempt to trap therein a single ion supplied by the ion source, (ii) recording, with the processor, ion measurement information based on output signals produced by the at least one amplifier over a duration of the ion trapping event, (iii) based on the recorded ion measurement information, determining with the processor whether the control of the ELIT or orbitrap resulted in trapping therein of a single ion, of no ion or of multiple ions, (iv) computing at least one of an ion mass and an ion mass-to-charge ratio based on the recorded ion measurement information only if a single ion was trapped in the ELIT or orbitrap during the trapping event, (v) repeatedly executing (i)-(iv), and (vi) constructing a histogram of the computed ones of the at least one of the ion mass and the ion mass-to-charge ratio for each of a plurality of different ion trapping events in real time following each determination that controlling the ELIT or orbitrap resulted in trapping therein of a single ion and subsequent computing of the one of the at least one of the ion mass and the ion mass-to-charge ratio.

* * * * *